US007070031B2

(12) United States Patent
Smith et al.

(10) Patent No.: US 7,070,031 B2
(45) Date of Patent: Jul. 4, 2006

(54) APPARATUS FOR EXERTING A RESISTING FORCE

(75) Inventors: Jeffery D. Smith, St. Charles, IL (US); Randy L Warner, Harrisburg, PA (US); Kelly R. Strong, Morgan, UT (US)

(73) Assignee: SCI Products Inc., Harrisburg, PA (US)

( * ) Notice: Subject to any disclaimer, the term of this patent is extended or adjusted under 35 U.S.C. 154(b) by 0 days.

(21) Appl. No.: 10/953,092

(22) Filed: Sep. 30, 2004

(65) Prior Publication Data

US 2005/0063777 A1 Mar. 24, 2005

Related U.S. Application Data

(62) Division of application No. 10/638,543, filed on Aug. 12, 2003.

(51) Int. Cl.
*F16F 9/00* (2006.01)
*E01F 15/00* (2006.01)

(52) U.S. Cl. ..... 188/382; 404/6; 256/13.1

(58) Field of Classification Search ..... 188/387, 188/371, 372, 376, 377, 382; 244/110 R, 244/110 A, 110 C; 404/6, 9, 10, 11; 256/13.1
See application file for complete search history.

(56) References Cited

U.S. PATENT DOCUMENTS 1,638,630 A 8/1927 Hannauer et al.
1,828,349 A 10/1931 Williams
2,022,745 A * 12/1935 Slavin ..... 404/11
2,047,436 A 7/1936 Shepherd
2,227,958 A 1/1941 Camp
2,731,219 A * 1/1956 Cotton et al. ..... 244/110 A
2,860,732 A * 11/1958 Snow ..... 244/110 A
2,969,944 A * 1/1961 Knecht ..... 244/110 A
2,987,278 A * 6/1961 Hoffman et al. ..... 244/110 A (Continued)

FOREIGN PATENT DOCUMENTS

DE 3705485 A1 9/1988

OTHER PUBLICATIONS

"Dragnet" Vehicle Safety Barrier System, Energy Absorption Systems, Inc. Catalog No. 8-OD.

(Continued)

*Primary Examiner*—Thomas J. Williams
(74) *Attorney, Agent, or Firm*—Nixon & Vanderhye P.C.

(57) ABSTRACT

An improved crash attenuator that uses a cable and shock arresting cylinder arrangement to control the rate at which a vehicle impacting the crash attenuator is decelerated to a safe stop is disclosed. The crash attenuator is comprised of a front section and a plurality of mobile sections with overlapping angular corrugated side panels. When the crash attenuator is impacted by a vehicle, the front section and mobile sections telescope down in response, and thus, are effectively longitudinally collapsed. For this purpose, the sections are slidably mounted on at least one guiderail that is attached to the ground. Positioned preferably between two guiderails is the cable and cylinder arrangement that exerts a force on the front section to resist the backward movement of the front section when struck by an impacting vehicle using a varying restraining force to control the rate at which an impacting vehicle is decelerated to safely stop the vehicle. The side panels can also be used in a guardrail configuration. A variety of transition arrangements to provide a smooth continuation from the crash attenuator to a fixed obstacle protected by the crash attenuator.

33 Claims, 27 Drawing Sheets

U.S. PATENT DOCUMENTS 3,211,260 A 10/1965 Jackson
3,272,460 A * 9/1966 Thomlinson ..... 244/110 A
3,307,832 A 3/1967 Van Zelm et al.
3,369,634 A 2/1968 Mazelsky
3,377,044 A 4/1968 Jackson et al.
3,428,275 A * 2/1969 Shinbaum et al. ..... 244/110 C
3,643,924 A 2/1972 Fitch
3,672,657 A 6/1972 Young et al.
3,674,115 A 7/1972 Young et al.
3,693,940 A * 9/1972 Kendall et al. ..... 256/13.1
3,845,936 A 11/1974 Boedecker, Jr.
3,871,636 A 3/1975 Boyle
3,944,187 A 3/1976 Walker
3,982,734 A 9/1976 Walker
4,160,561 A 7/1979 Farnam et al.
4,227,593 A 10/1980 Bricmont et al.
4,321,989 A 3/1982 Meinzer
4,352,484 A 10/1982 Gertz et al.
4,399,980 A 8/1983 van Schie
4,407,484 A 10/1983 Meinzer
4,452,431 A 6/1984 Stephens et al.
4,460,161 A 7/1984 Grenga
4,498,561 A 2/1985 Sanders
4,572,080 A 2/1986 Williams et al.
4,576,508 A 3/1986 Dickinson
4,583,716 A 4/1986 Stephens et al.
4,607,824 A 8/1986 Krage et al.
4,655,434 A 4/1987 Bronstad
4,674,911 A 6/1987 Gertz
4,784,515 A 11/1988 Krage et al.
4,815,565 A 3/1989 Sicking et al.
4,824,282 A * 4/1989 Waldecker ..... 404/6
4,838,523 A 6/1989 Humble et al.
4,844,213 A 7/1989 Travis
5,022,782 A 6/1991 Gertz et al.
5,112,028 A 5/1992 Laturner
5,125,762 A 6/1992 Strassil
5,192,517 A 3/1993 Laturner
5,217,318 A 6/1993 Peppel
5,248,129 A 9/1993 Gertz
5,306,106 A 4/1994 Mileti
5,391,016 A 2/1995 Ivey et al.
5,403,113 A 4/1995 Gertz et al.
5,425,594 A 6/1995 Krage et al.
5,431,475 A 7/1995 Perry
5,490,661 A 2/1996 Stevens et al.
5,494,371 A 2/1996 Oberth et al.
5,566,794 A * 10/1996 Wiard ..... 188/287
5,577,861 A 11/1996 Oberth et al.
5,624,203 A 4/1997 Jackson et al.
5,634,738 A 6/1997 Jackson et al.
5,642,792 A 7/1997 June
5,733,062 A 3/1998 Oberth et al.
5,797,591 A 8/1998 Krage
5,797,592 A 8/1998 Machado
5,823,705 A 10/1998 Jackson et al.
5,829,912 A 11/1998 Marcotullio et al.
5,865,521 A 2/1999 Hashizume et al.
5,868,521 A 2/1999 Oberth et al.
5,924,680 A 7/1999 Sicking et al.
5,947,452 A 9/1999 Albritton
5,993,104 A 11/1999 Marcotullio et al.
6,022,003 A 2/2000 Sicking et al.
6,024,341 A 2/2000 Gertz
6,062,765 A 5/2000 Dotson
6,343,821 B1 2/2002 Breed
6,412,230 B1 7/2002 Zambelli et al.
6,536,985 B1 3/2003 Albritton ..... 404/6
6,843,613 B1 * 1/2005 Gelfand et al. ..... 404/6

OTHER PUBLICATIONS

Drawing "Crash-Cushion Attenuating Terminal" Syro Steel Company Girard, Ohio and Centerville, Utah.
Drawing "Guardrail Extruder Terminal" GET-89 State Department of Highways and Public Transportation Table III-B-4. Operational Roadside Barrier End Treatments.
Hirsch, Hayes and Ivey, "Dragnet Vehicle Arresting System" (Technical Memorandum 505-4) (Feb. 28, 1969).
International Search Report for International Application No. PCT/US04/25874 (International Filing Date Aug. 11, 2004).
Written Opinion attached to International Search Report for International Application No. PCT/US04/25874 (International Filing Date Aug. 11, 2004).
International Preliminary report on Patentability, issued in corresponding International Application No. PCT/US2004/025874 on Feb. 13, 2006.
Written Opinion of the International Searching Authority, issued in corresponding International Application No. PCT/US2004/025874 on Feb. 13, 2006.

* cited by examiner 26
28/16
20
22
104
106
110
120
122

APPARATUS FOR EXERTING A RESISTING FORCE

This application is a divisional of application Ser. No. 10/638,543, filed Aug. 12, 2003, the entire contents of which are hereby incorporated by reference in this application.

FIELD OF THE INVENTION

The present invention relates to vehicle crash attenuators, and, in particular, to a crash attenuator for controlling the deceleration of crashing vehicles using a cable and cylinder braking arrangement.

BACKGROUND OF THE INVENTION

The National Cooperative Highway Research Programs Report, NCHRP Report 350, specifies criteria for evaluating the safety performance of various highway devices, such as crash attenuators. Included in NCHRP Report 350 are recommendations for run-down deceleration rates for vehicles to be used in designing crash attenuators that meet NCHRP Report 350's test levels 2, 3 and 4.

To meet the criteria specified in NCHRP Report 350, most crash attenuators that are deployed today along roadways to redirect or stop vehicles that have left the roadway use various structural arrangements in which the barrier compresses and/or collapses in response to the vehicle impacting the barrier. Some of these crash attenuators also include supplemental braking systems that produce a constant retarding force to slow down crashing vehicles, despite variations in the mass and/or velocity of the vehicle impacting the barrier.

The guidelines in NCHRP Report 350 for crash testing require a maximum vehicle occupant impact speed which is the speed of the occupant striking the interior surface of the vehicle, of 12 meters/second, with a preferred speed of 9 meters/second. Typically, constant braking force crash attenuators will stop a smaller mass vehicle in a distance of around 8 feet. This is because most constant braking force crash attenuators need to exert an increased braking force that will allow larger mass vehicles, such as pickup trucks, to be stopped in a distance of around 17 feet.

SUMMARY OF THE INVENTION

The present invention is an improved crash attenuator that uses a cable and cylinder braking arrangement to control the rate at which a vehicle impacting the crash attenuator is decelerated to a safe stop. In particular, the crash attenuator of the present invention uses a cable and cylinder arrangement that exerts a resistive force that varies over distance to control a crashing vehicle's run-down deceleration and occupant impact speed in accordance with the requirements of NCHRP Report 350. Thus, the crash attenuator of the present invention provides a ride-down travel distance for smaller mass vehicles in which such vehicles, during a high speed impact, are able to travel 10 feet or more before completely stopping.

The crash attenuator of the present invention also includes an elongated guardrail-like structure comprised of a front impact section and a plurality of trailing mobile sections with overlapping side panel sections that telescope down as the crash attenuator is compressed in response to being struck by a vehicle. The front impact section is rotatably mounted on at least one guiderail attached to the ground, while the mobile sections are slidably mounted on the at least one guiderail. It should be noted, however, that two or more guiderails are preferably used with the crash attenuator of the present invention.

Positioned preferably between two guiderails on the ground is the cable and cylinder arrangement. The cable and cylinder arrangement includes preferably a steel wire rope cable that is attached to a sled that is part of the attenuator's front impact section by means of an open spelter socket attached to the sled. From the open spelter socket, the cable is pulled through an open backed tube that is affixed to the front base of the crash attenuator. At the rear of the attenuator is a shock-arresting hydraulic or pneumatic cylinder with a first stack of static sheaves positioned near the back end of the cylinder and a second stack of static sheaves on the end of the cylinder's protruding piston rod. All of the sheaves are pinned and rotationally stationary during impact of the crash attenuator by a vehicle. The cable is looped several times around the static sheaves located at the rear of the cylinder and at the end of the cylinder's piston rod. Thereafter, the cable is terminated to a threaded adjustable eyebolt that is attached to a plate welded to the side of one of the base rails.

When a crashing vehicle impacts the front section of the crash attenuator, the front section is caused to translate backwards on the guiderails towards the multiple mobile sections located behind the front section. As the front section translates backwards, the rear-most portion of a sled acting as its support frame comes into contact with the support frame supporting the panels of the mobile section just behind the front section. This mobile section's support frame, in turn, comes into contact with the support frame supporting the panels of the next mobile section, and so on.

As the sled and support frames translate backwards, the cable attached to the sled is caused to frictionally slide around the sheaves and compress or extend the cylinder's piston rod into or out of the cylinder. The sheaves located at the end of the piston rod are also attached to a movable plate so that the sheaves move longitudinally as the cylinder's piston rod is compressed into or extended out of the cylinder by the cable as it slides around the sheaves in response to the front section of the crash attenuator being impacted by a vehicle. This results in a restraining force being exerted on the sled to control its backward movement. The restraining force exerted by the cable on the sled is controlled by the cylinder, which is metered using internal orifices to give a vehicle impacting the attenuator a controlled ride-down based on the vehicle's kinetic energy. Initially, a minimum restraining force is applied to the front section to decelerate the crashing vehicle until the point of occupant impact with the interior surface of the vehicle, after which an increased resistance, but steady deceleration force, is maintained. Thus, the present invention uses a cable and cylinder arrangement with a varying restraining force to control the rate at which a crashing vehicle is decelerated to safely stop the vehicle. Accelerating the mass of the frames during collision also contributes to the stopping force. Therefore, the total stopping force is a combination of friction, the resistance exerted by the shock arresting cylinder and the acceleration of structural masses in response to the velocity of the colliding vehicle upon impact and crush factors in the body and frame of the vehicle.

The crash attenuator of the present invention also includes a variety of transition arrangements to provide a smooth continuation from the crash attenuator to a fixed barrier of varying shape and design. The structure of the transition unit varies according to the type of fixed barrier that the crash attenuator is connected to.

The cable and cylinder arrangement used in the crash attenuator of the present invention can be used with or in other structural arrangements that are designed to bear impacts by vehicles and other moving objects. The alternative embodiments of the cable and cylinder arrangement with such alternative structural arrangements would include the cable, the cylinder and sheaves used in the cable and cylinder arrangement of the crash attenuator of the present invention.

DESCRIPTION OF THE PREFERRED EMBODIMENT

Figure 1:
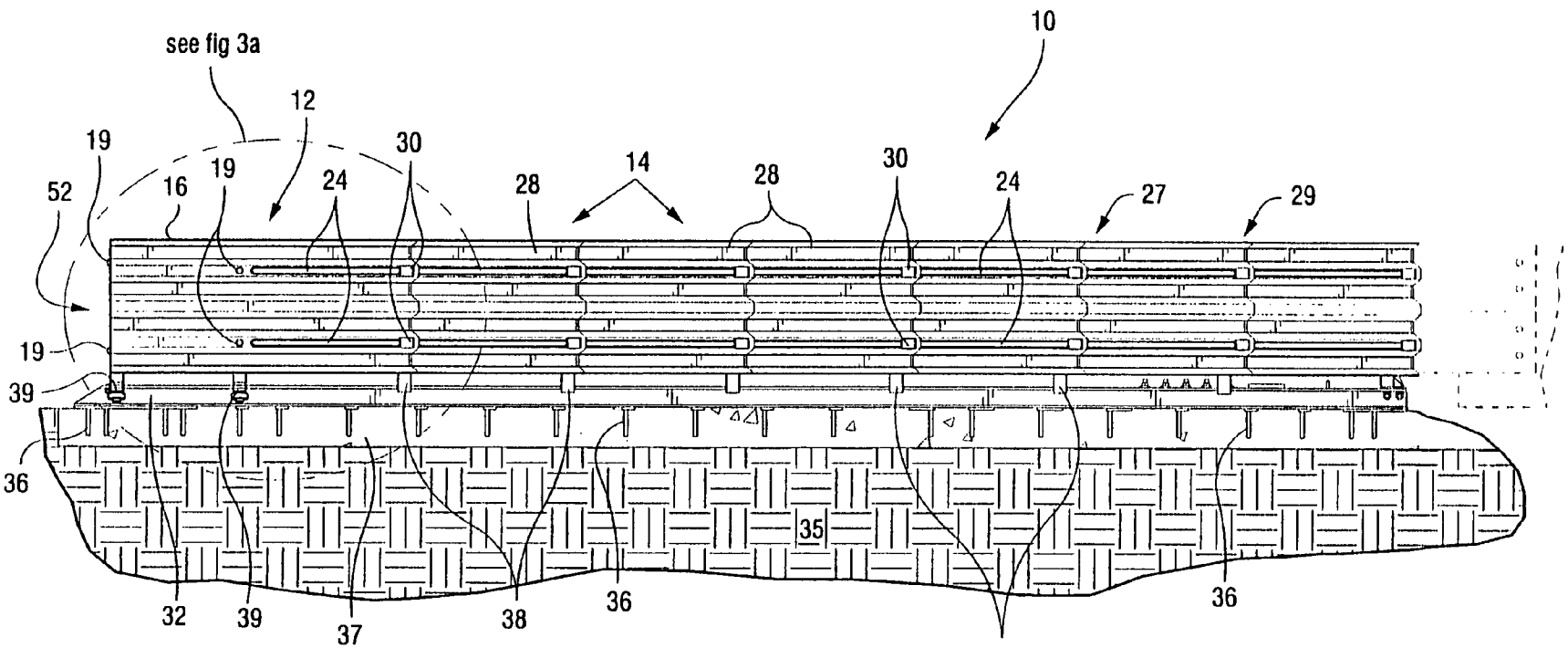
FIG. 1 is a side elevational view of the crash attenuator of the present invention in its fully-extended position.
Figure 2:
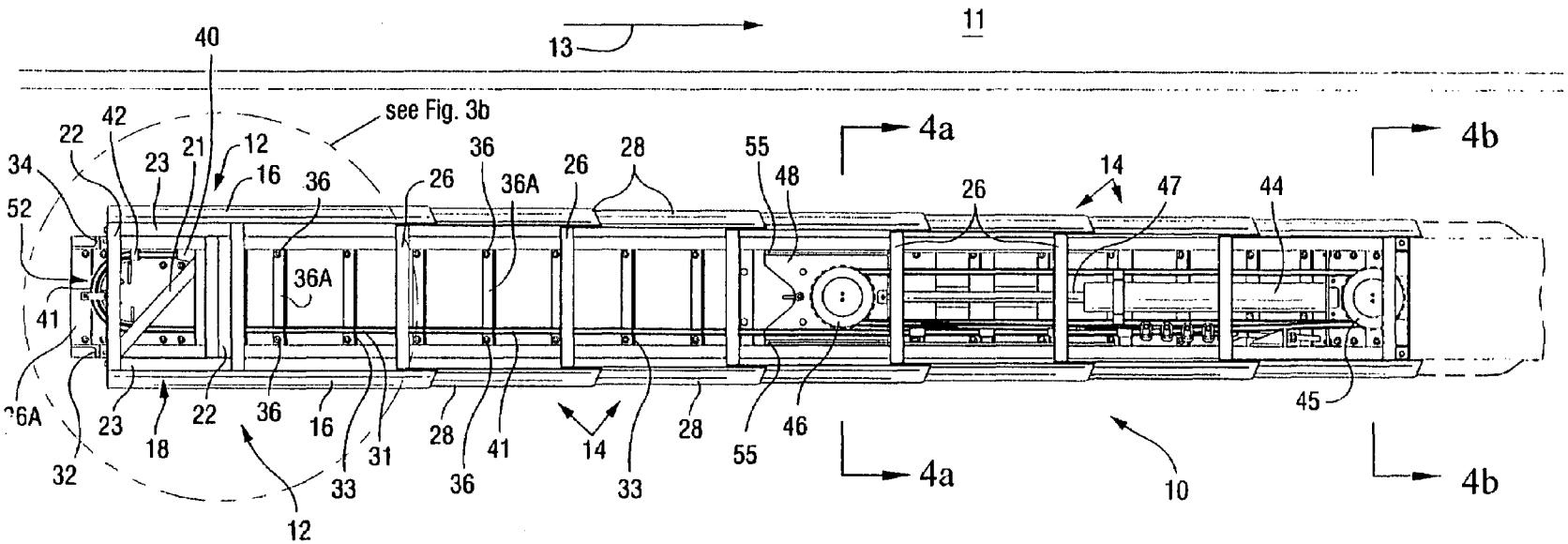
FIG. 2 is a plan view of the crash attenuator of the present invention in its fully-extended position.

The present invention is a vehicle crash attenuator that uses a cable and cylinder arrangement and collapsing structure to safely decelerate a vehicle impacting the attenuator. FIG. 1 is a side elevational view of the preferred embodiment of the crash attenuator 10 of the present invention in its fully extended position. FIG. 2 is a plan view of the crash attenuator 10 of the present invention, again in its fully extended position.

Referring first to FIGS. 1 and 2, crash attenuator 10 is an elongated guardrail-type structure including a front section 12 and a plurality of mobile sections 14 positioned behind front section 12. As shown in FIGS. 1 and 2, front section 12 and mobile sections 14 are positioned longitudinally with respect to one another. Crash attenuator 10 is typically positioned alongside a roadway 11 and oriented with respect to the flow of traffic in roadway 11 shown by arrow 13 in FIG. 2.

Figure 6A:
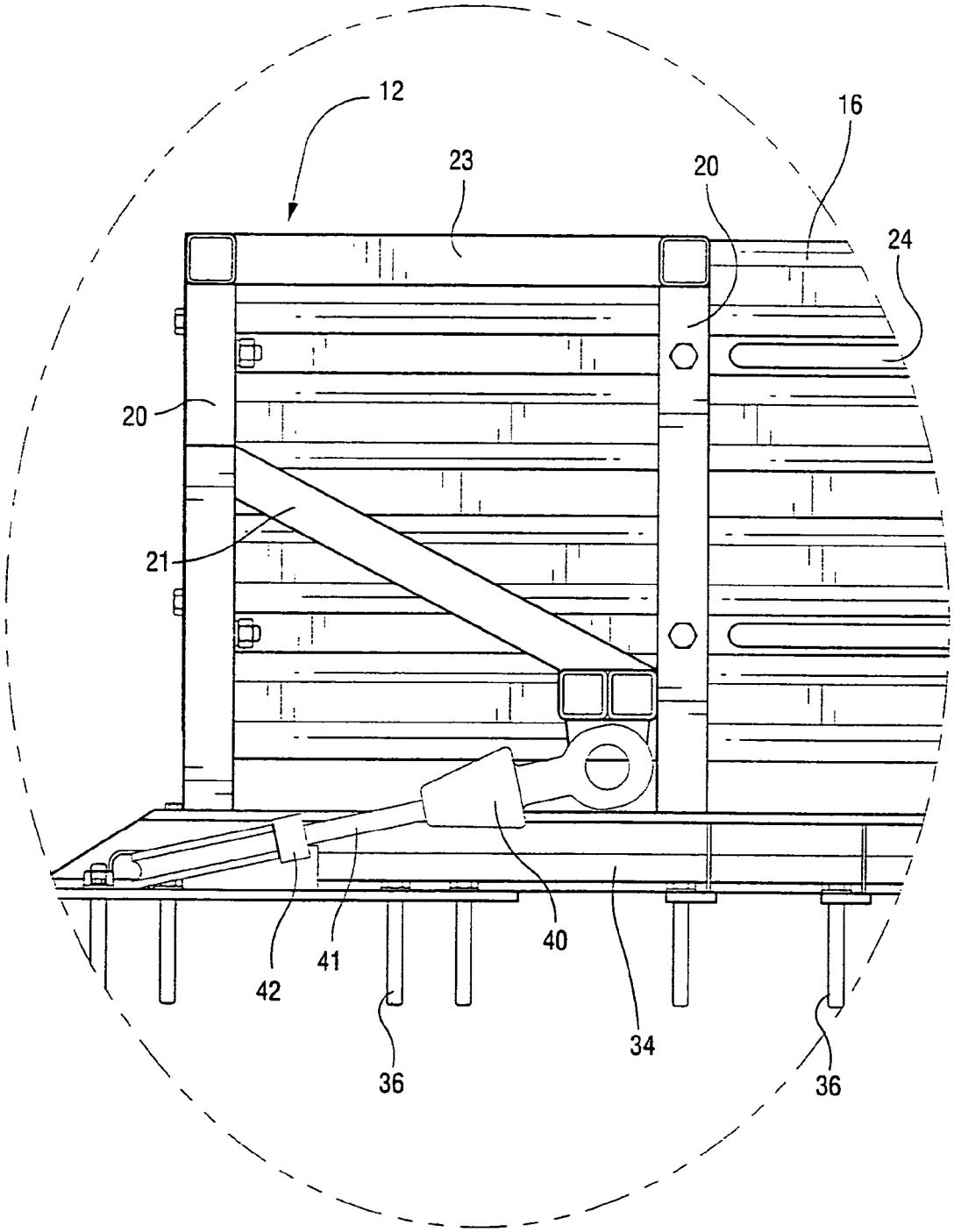
FIG. 6*a* is an enlarged cross-sectional side elevational view of the front section of the crash attenuator shown in FIG. 5. (spelter socket pin not shown)

As shown in FIGS. 1, 2, 3*a*, and 3*b*, mounted on each of front section 12's two sides is a corrugated panel 16 which preferably has a trapezoidal-like profile. Supporting these panels 16 is a rectangular-shaped frame or sled 18 that is constructed from four vertical frame members 20, which, in turn, are joined by four laterally extending substantially parallel cross-frame members 22 and four longitudinally extending substantially parallel cross-frame members 23 for structural rigidity. As shown in FIG. 6*a*, front section 12 also includes a diagonal-support member 21 extending horizontally and diagonally from the front right of sled 18 to the rear left of sled 18 so as to form a lattice-like structure to resist twisting of sled 18 upon angled frontal hits. Preferably, vertical frame members 20, cross-frame members 22, cross-frame members 23 and diagonal-support member 21 are all constructed from mild steel tubing and are welded together. Preferably, each of panels 16 includes two substantially horizontal slits 24 that extend a partial distance along the length of panel 16 and is mounted on one side of vertical frame members 20 by two bolts 19. For front side panel 16, there are two additional mounting bolts 19 holding the front of panel 16.

As shown in FIGS. 5 and 18*a*–18*c*, each of the mobile sections 14 is constructed with a rectangular-shaped frame 26 that also includes a pair of vertical frame members 20 joined, again, together by a pair of cross-frame members 22. Preferably, members 20 and 22 forming frames 26 are also constructed from mild steel tubing and welded together. Mounted on each side of each of the vertical frame members 20 of mobile sections 14 is a corrugated side panel 28 that is somewhat shorter in length than each of side panels 16, but that also have a trapezoidal-like profile like side panels 16. FIGS. 1 and 2 show that each frame 26 supports a pair of panels 28, one on each side of frame 26. Preferably, panels 28 are also made from galvanized steel. Each of panels 28 also includes two substantially horizontal slits 24 that extend a partial distance along the length of panel 28 and is mounted on one side of vertical frame members 20 by two keeper bolts 30, which protrude through horizontal slits 24 of preceding and partially overlapping panel 16. As can be seen in FIG. 1, overlapping panels 16 and 28 act as deflection plates to redirect a vehicle upon laterally striking the crash attenuator 10.

Figure 3A:
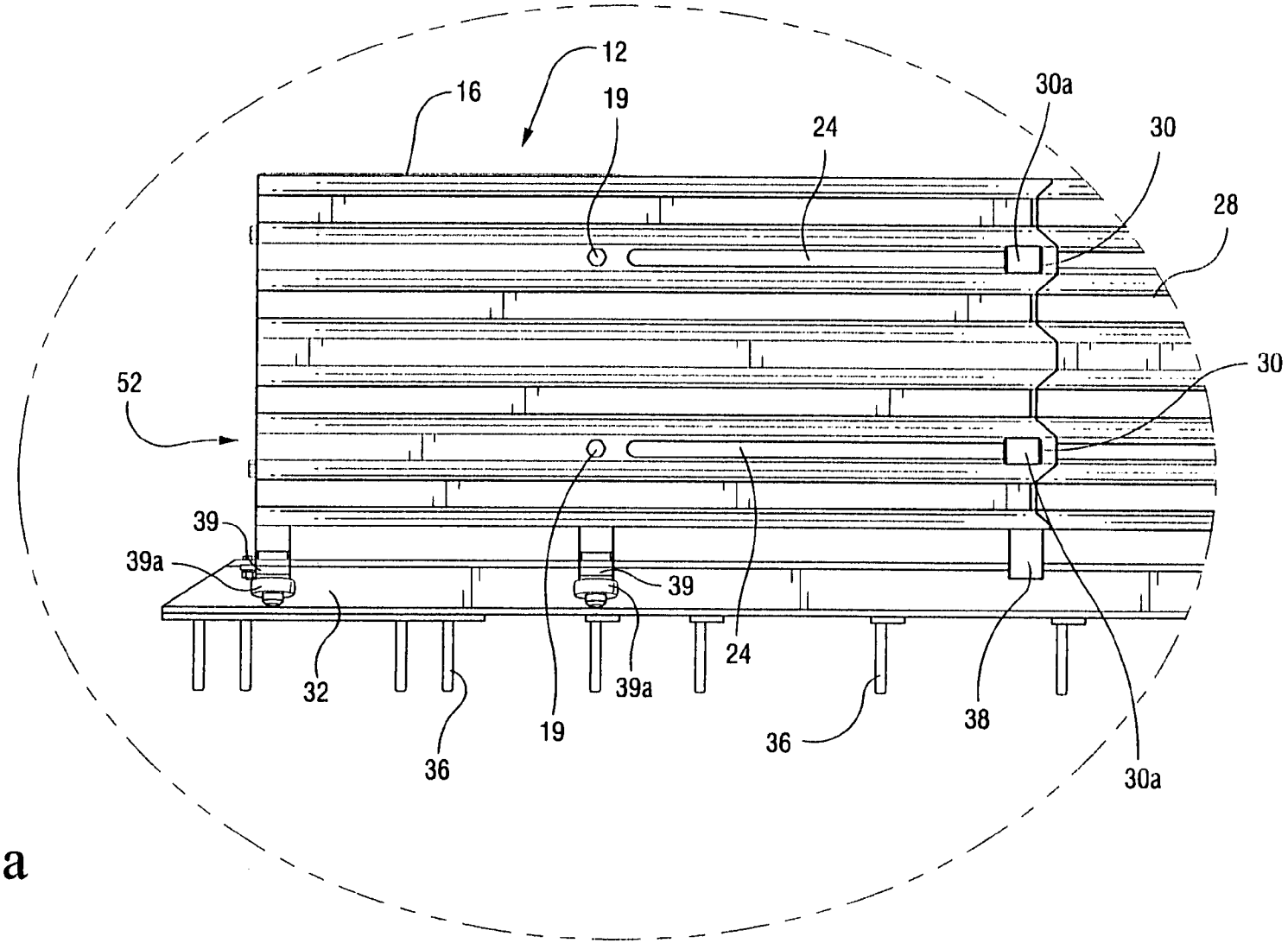
FIG. 3*a* is an enlarged partial side elevational view of the front section of the crash attenuator of the present invention.
Figure 5:
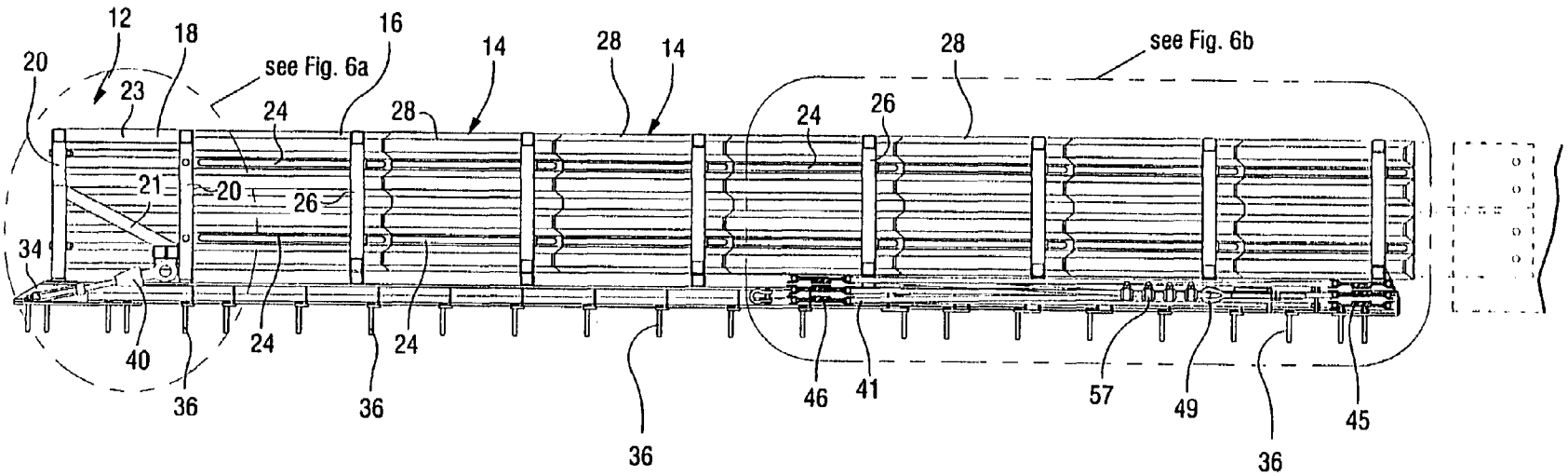
FIG. 5 is a cross-sectional side elevational view of the crash attenuator shown in FIG. 1.
Figure 8:
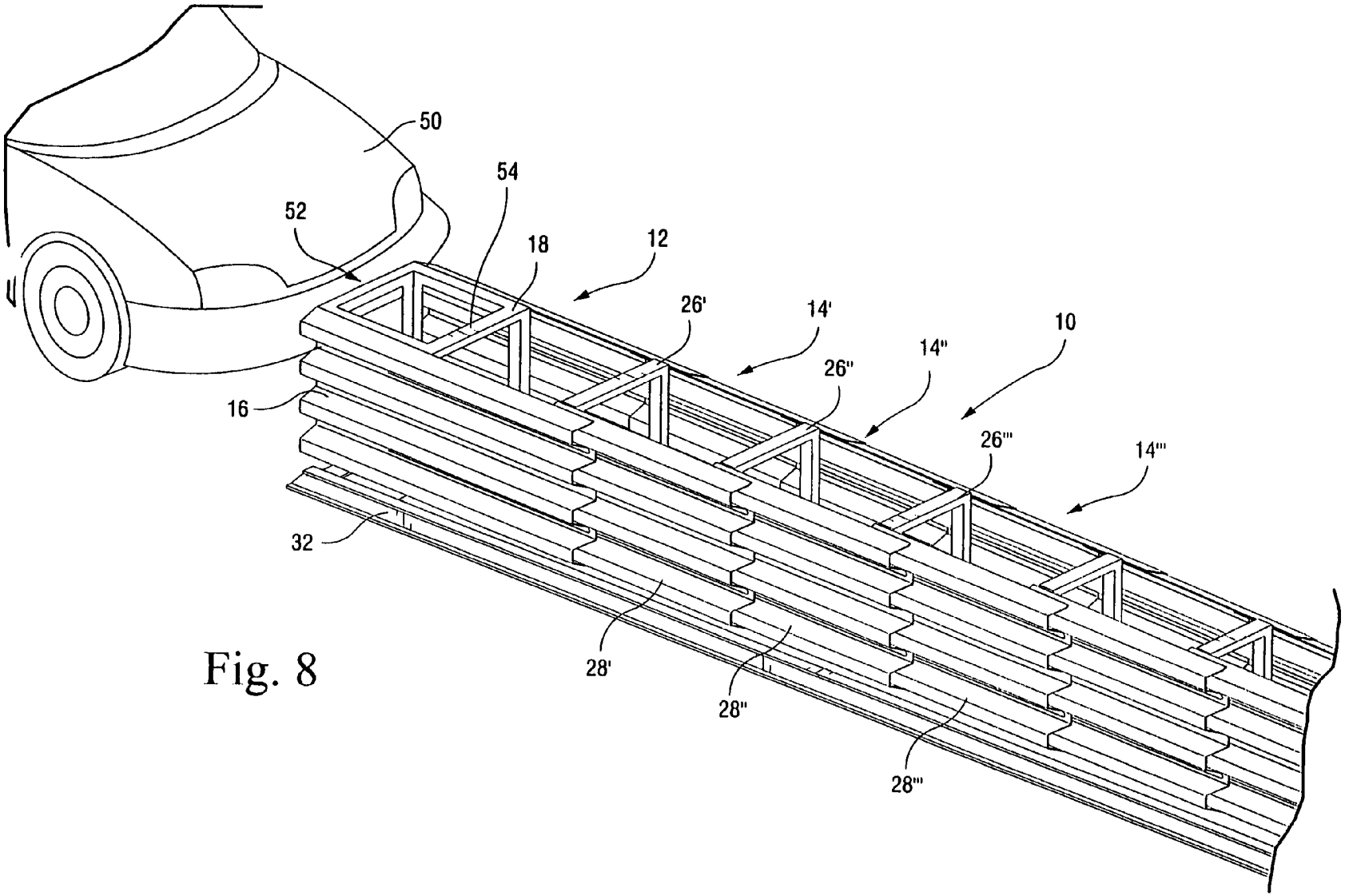
FIG. 8 is a side elevational perspective view of the crash attenuator in its rest position just prior to impact by a vehicle.
Figure 9:
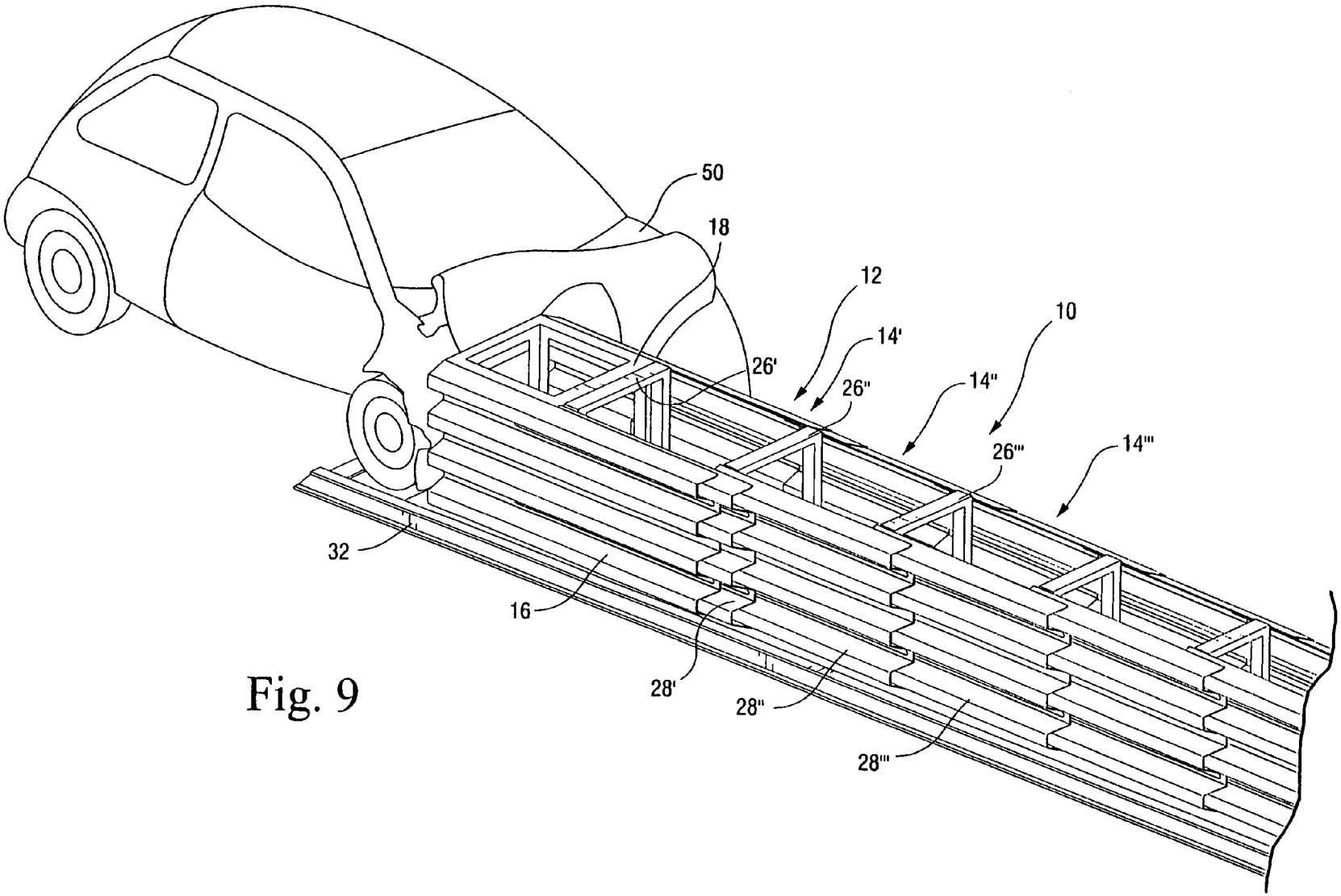
FIG. 9 is a side elevational perspective view of the crash attenuator in which the front section of the attenuator has moved backward and impacted the support frame for the first mobile section of the guardrail structure immediately behind the front section.
Figure 10:
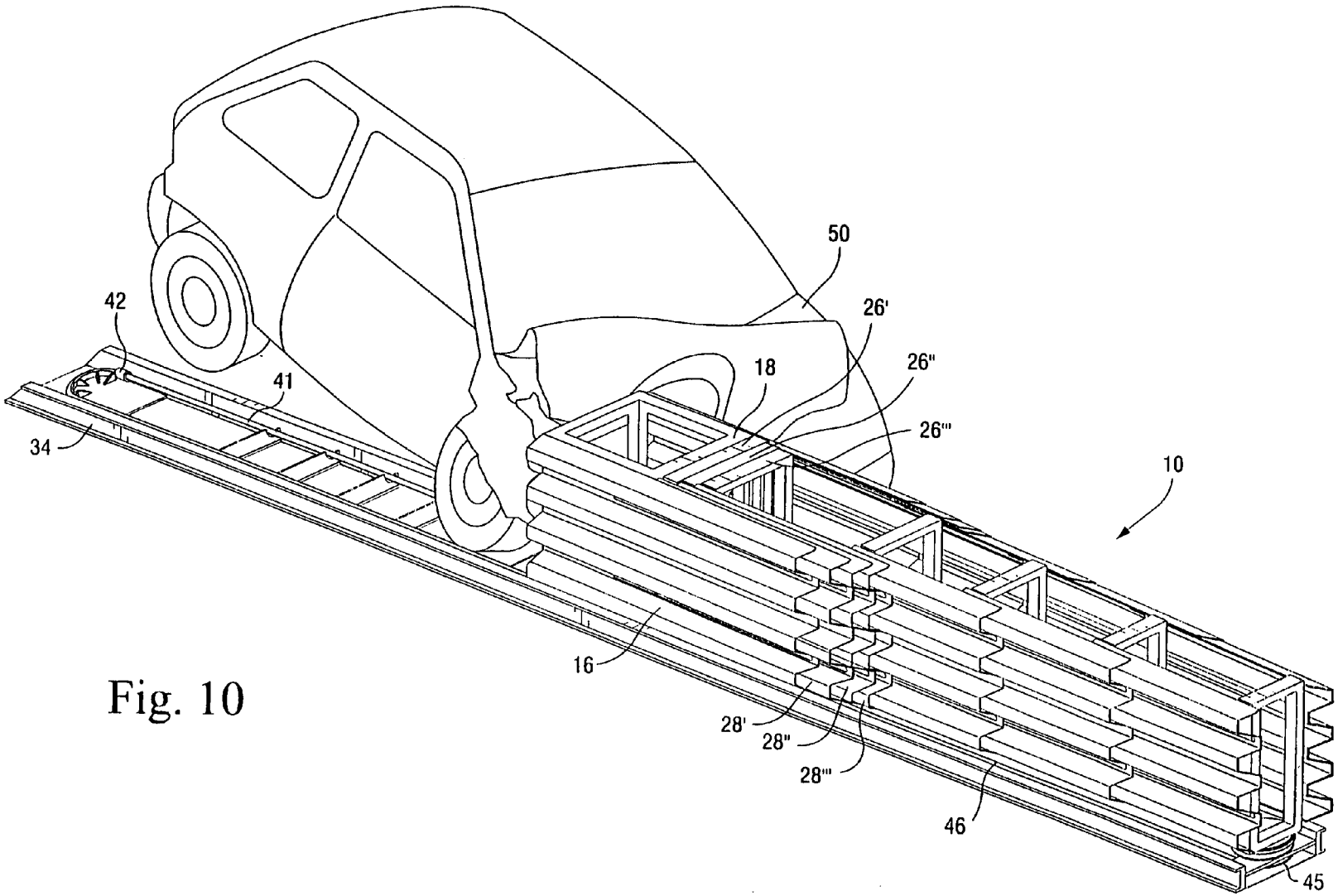
FIG. 10 is a side elevational perspective view of the crash attenuator in which the front section and the first and second mobile sections of the attenuator have moved backwards after vehicle impact so as to engage the support structure of the third mobile section of the guardrail structure.
Figure 15:
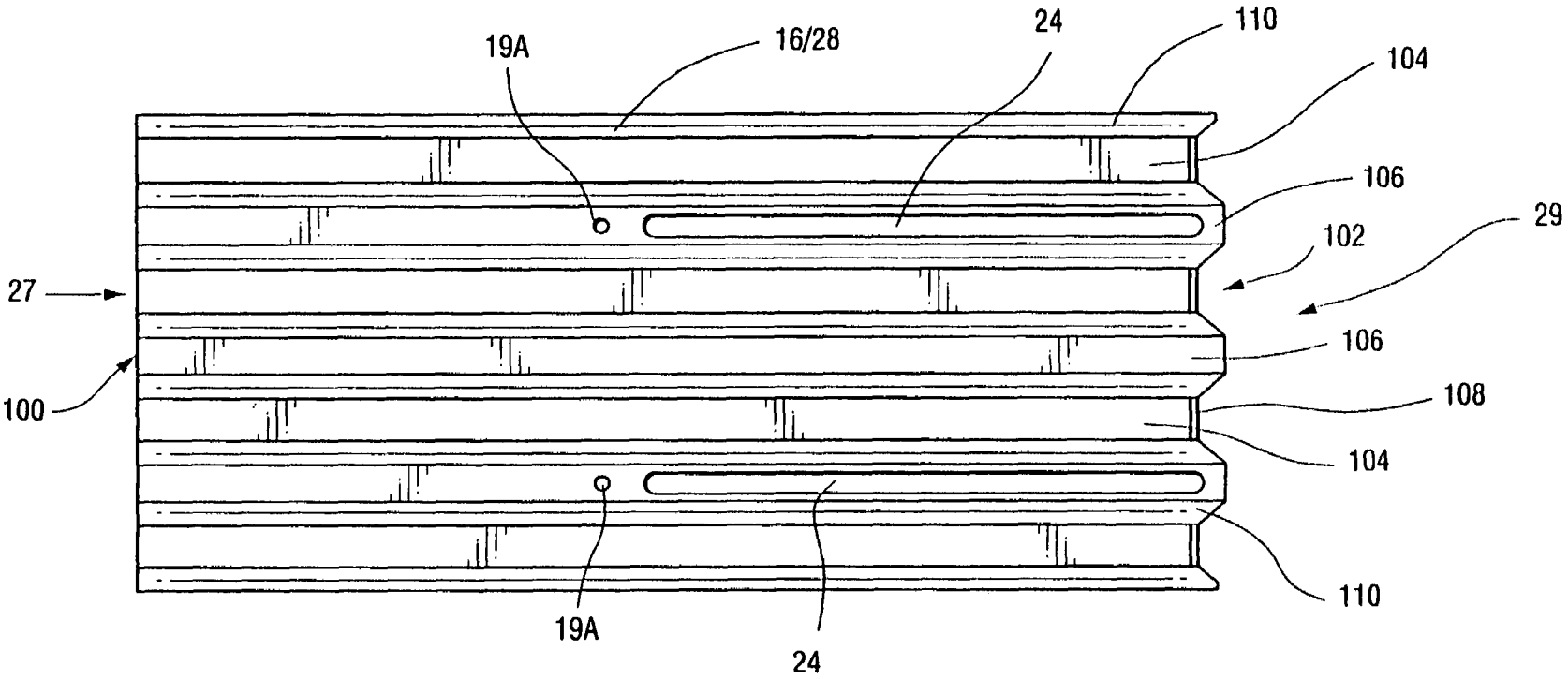
FIG. 15 is a plan view of the corrugated side panel used with the front section and mobile sections of the crash attenuator of the present invention, the front section panel being a longer version of the mobile section panels.

Front section 12 and mobile sections 14 are not rigidly joined to one another, but interact with one another in a sliding arrangement, as best seen in FIGS. 8–10. As shown in FIGS. 1 and 5, each of corrugated panels 28 is joined to a vertical support member 20 of a corresponding support frame 26 by a pair of side-keeper bolts 30 that extend through a pair of holes (not shown) in panels 28. The first pairs of side-keeper bolts 30 holding panels 28 onto the first support frame 26 behind front section 12 protrude through slits 24 in panels 16 supported by sled 18. The subsequent pairs of side-keeper bolts 30 each also protrude through the slits 24 that extend horizontally along a panel 28 that is longitudinally ahead of that pair of bolts. Thus, as shown in FIGS. 1 and 15, each of corrugated panels 28 has a fixed end 27 joined by a pair of side-keeper bolts 30 to a support frame 26 and a floating end 29 through which a second pair of side-keeper bolts 30 protrudes through the slits 24 extending along the panel, such that the floating end 29 of the panel overlaps the fixed end 27 of the corrugated panel 28 longitudinally behind it and adjacent to it. Referring now to FIG. 3*a*, each of side-keeper bolts 30 preferably includes a rectangular-shaped head 30*a* having a width that is large enough to prevent the corresponding slit 24 through which the bolt 30 extends from moving sideways away from its supporting frame 26.

Figure 7:
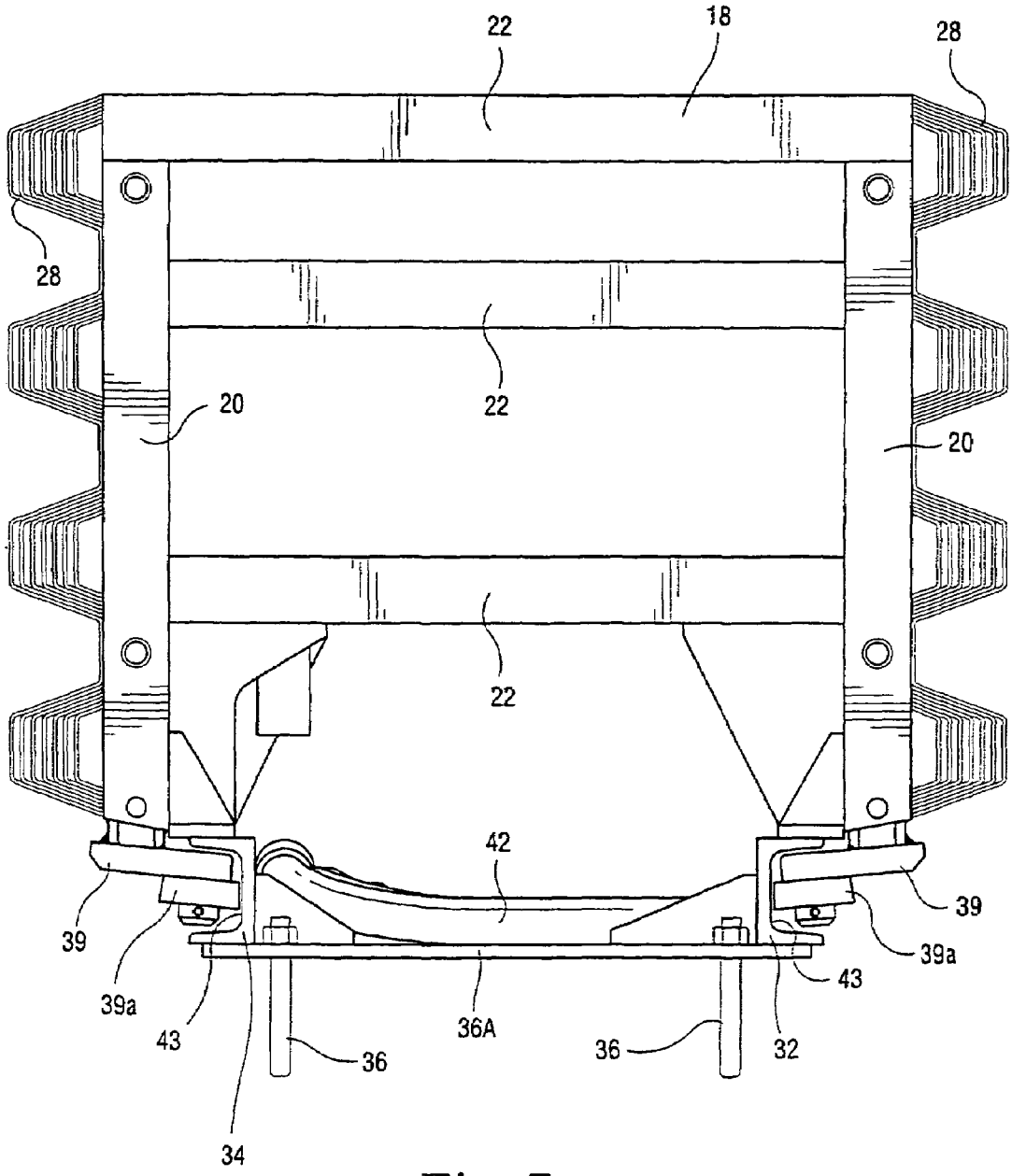
FIG. 7 is a cross-sectional front elevational view of the guardrail structure when completely collapsed after impact.

As shown in FIGS. 5 and 7, sled 18 of front section 12 is rotatably mounted on preferably two substantially parallel guiderails 32 and 34, while each of support frames 26 of mobile sections 14 are all slidably mounted on guiderails 32 and 34. Guiderails 32 and 34 are steel C-channel rails that are anchored to the ground 35 by a plurality of anchors 36. Anchors 36 are typically bolts that protrude through guiderail support plates 36A into a suitable base material, such as concrete 37 or asphalt (not shown), that has been buried in the ground 35. The base material is used as a drill template for anchors 36. Preferably, the base material is in the form of a pad extending at least the length of crash attenuator 10. Preferably this pad is a 28 MPa or 4000 PSI min. steel reinforced concrete that is six inches thick and flush with the ground. Mounting holes in concrete 37 receive anchors 36 protruding through guiderail support plates 36A.

Front section 12 is rotatably mounted on guiderails 32 and 34 by a plurality (preferably four) of roller assemblies 39 on which sled 18 of front section 12 is mounted to prevent sled 18 from hanging up as it slides along guiderails 32 and 34. Each of roller assemblies 39 includes a wheel 39*a* that engages and rides on an inside channel 43 of C-channel rails 32 and 34. Support frames 26 are attached to guiderails 32 and 34 by a bracket 38 that is a side guide that engages the upper portion of guiderails 32 and 34. Each of support section frames 26 includes a pair of side guides 38. Each side guide 38 supporting mobile sections 14 is bolted or welded to one side of the vertical support members 20 used to form frames 26. The side guides 38 track guiderails 32 and 34 back as the crash attenuator telescopes down in response to a frontal hit by a crashing vehicle 50. By roller assemblies 39 and side guides 38 engaging guiderails 32 and 34, they serve the functions of giving attenuator 10 longitudinal strength, deflection strength, and impact stability by preventing crash attenuator 10 from buckling up or sideways upon frontal or side impacts, thereby allowing a crashing vehicle to be redirected during a side impact.

It is possible to use a single guiderail 32/34 with the crash attenuator 10 of the present invention. In that instance, a single rail with back-to-back C-channels would be anchored to the ground 35 by a plurality of anchors 36. In this embodiment, front section 12 would again be rotatably mounted on the guiderail 32/34 by a plurality of roller assemblies 39 including wheels 39*a* that engage and ride on inside channels 43 of the back-to-back C-channels of single guiderail 32/34. Similarly, each of support frames 26 would include a pair of side guides 38 that would slidably track guiderail 32/34 as crash attenuator 10 telescopes down in response to a frontal hit by a crashing vehicle 50. One difference with this embodiment would be skid legs (not shown) mounted on the outside of front section 12 and support frames 26 for balancing purposes. Located on the bottom of the skid legs would be a skid that slides along the base material, such as concrete 37, buried in ground 35.

As shown in FIGS. 8 to 10, when a crashing vehicle 50 hits the front surface of crash attenuator 10, it strikes front section 12 containing sled 18. Front section 12 and sled 18 are then caused to translate backwards on guiderails 32 and 34 towards mobile sections 14 behind front section 12. As front section 12 translates backwards, the rear-most part of sled 18 crashes into the support frame 26' of the first mobile section 14' just behind front section 12. This first section's support frame 26', in turn, crashes into the support frame 26" of the next mobile section 14", and so on.

Figure 3B:
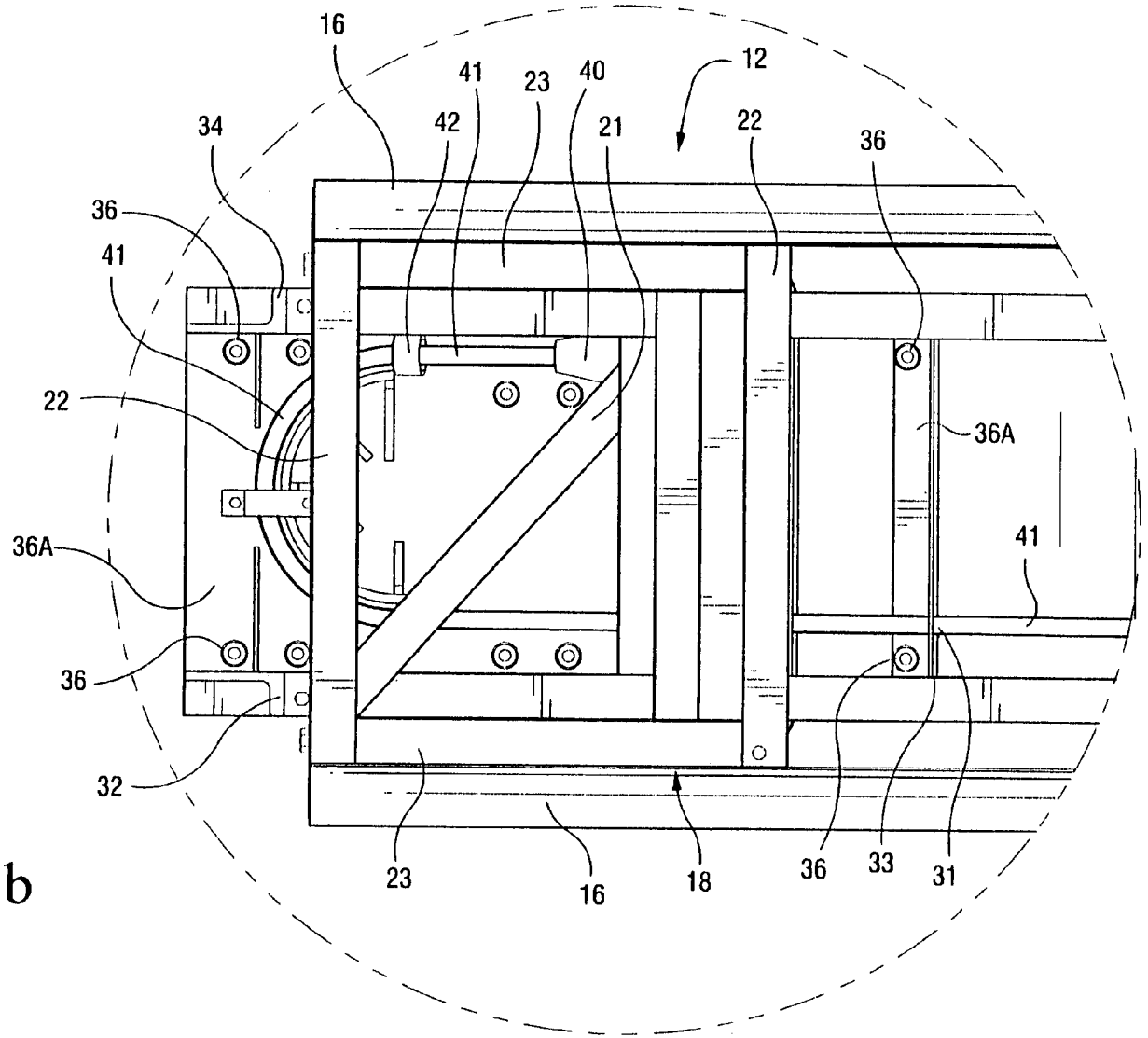
FIG. 3*b* is an enlarged partial plan view of the front section of the crash attenuator of the present invention.

As shown in FIGS. 2 and 3*b*, a cable 41 is attached to front sled 18 by an open spelter socket 40 attached to sled 18. Preferably, cable 41 is a 1.125" diameter wire rope cable formed from galvanized steel. It should be noted, however, that other types and diameter cables made from different materials could also be used. For example, cable 41 could be formed from metals other than galvanized steel, or from other non-metallic materials, such as nylon, provided that cable 41, when made from such other materials has sufficient tensile strength, which is preferably at least 27,500 lbs. Cable 41 could also be a chain rather than a rope design, provided that it has such tensile strength.

Figure 4A:
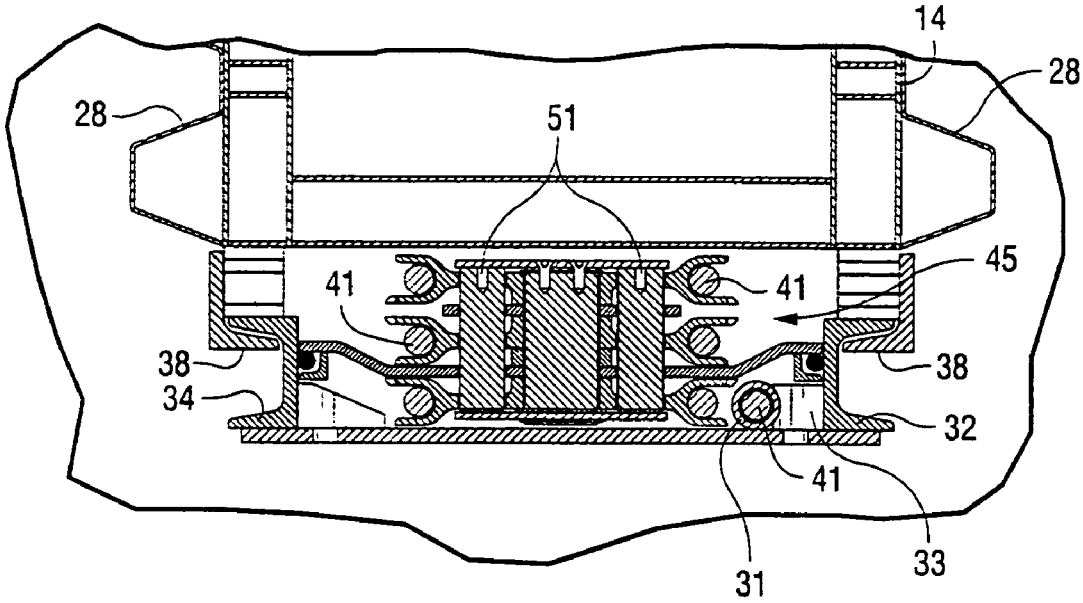
FIG. 4*a* is an enlarged cross-sectional, front elevational view, taken along line 4*a*—4*a* of FIG. 2, of the mobile sheaves used with the crash attenuator of the present invention.
Figure 4B:
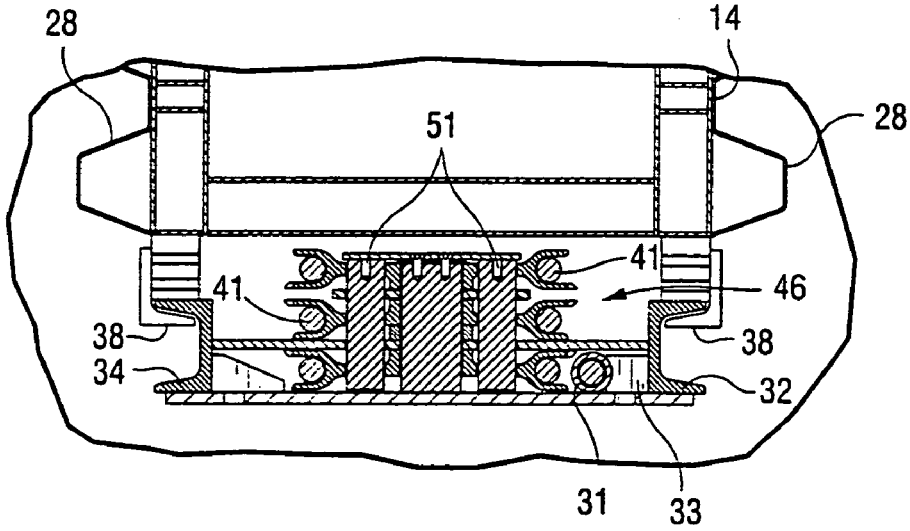
FIG. 4*b* is an enlarged cross-sectional front elevational view, taken along line 4*b*—4*b* of FIG. 2, of the stationary sheaves used with the crash attenuator of the present invention.

From spelter socket 40, cable 41 is then pulled through a stationary sheave that is an open backed tube 42 and that is mounted on a front guiderail support plate 36A of crash attenuator 10. Cable 41 then runs to the rear of crash attenuator 10, where there is located a shock-arresting cylinder 44 including an initially extended piston rod 47, a first multiplicity of sheaves 45 positioned at the rear end of cylinder 44, and a second multiplicity of sheaves 46 positioned at the front end of rod 47 extending from cylinder 44. FIG. 4*b* shows the circular steel guide ring bushings 31 attached to guiderail 32 by gusset 33 that help protect cable 41 as it travels back to cylinder 44 through a plurality of gussets 33 (see, e.g., FIG. 2) extending between guiderails 32 and 34. At the rear of crash attenuator 10, cable 41 first runs to the bottom sheave of multiple sheaves 45 positioned at the back of cylinder 44. Cable 41 then runs to the bottom sheave of multiple sheaves 46 positioned at the front end of cylinder piston rod 47.

Figure 6B:
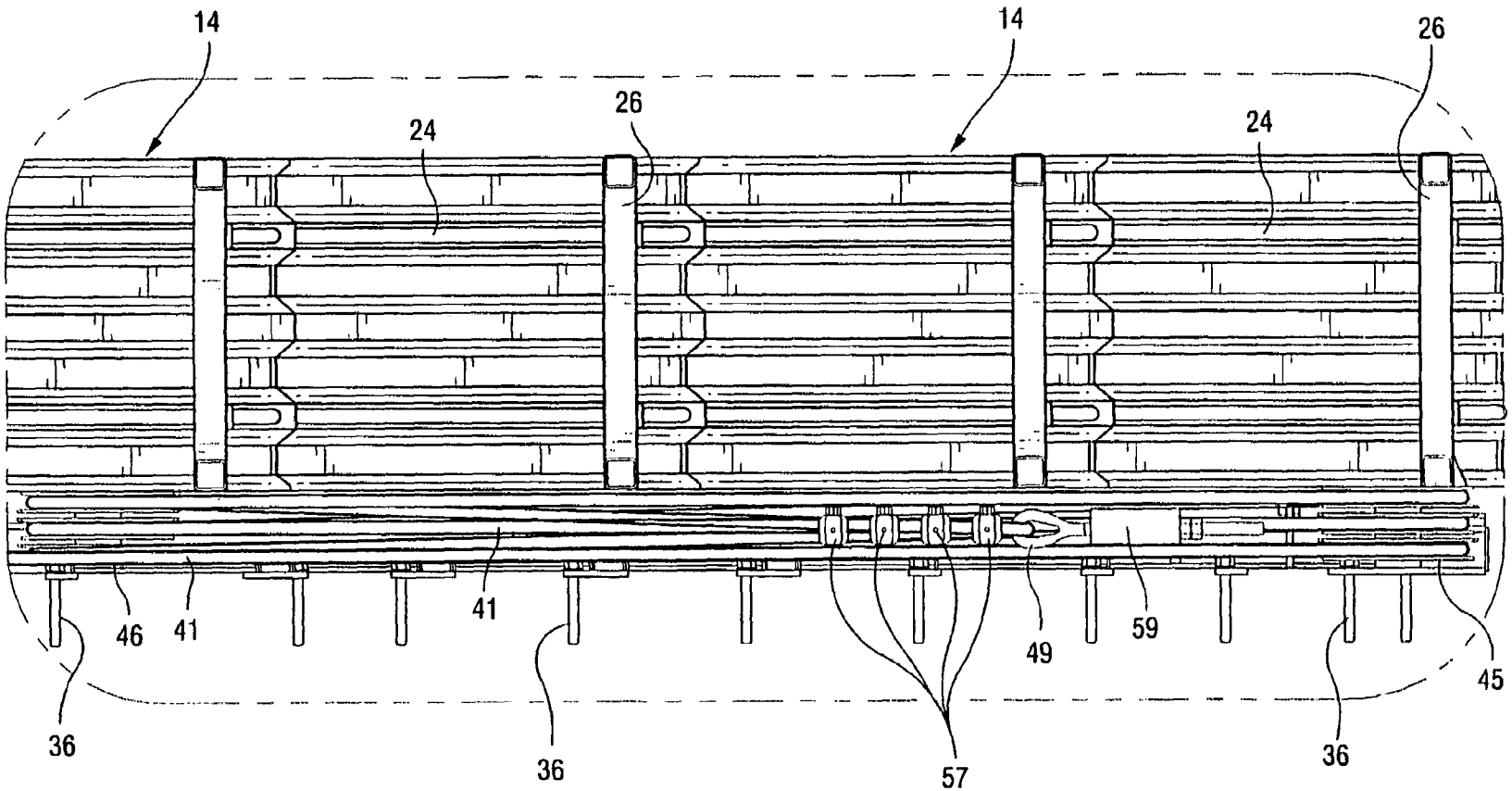
FIG. 6*b* is an enlarged cross-sectional side elevational view of several rear sections of the crash attenuator shown in FIG. 5.

Multiple sheaves 46 are attached to a movable plate 48, which slides longitudinally backwards as cylinder piston rod 47 is compressed into cylinder 44. Preferably, cable 41 is looped a total of three times around multiple sheaves 45 and 46, after which cable 41 is terminated in a threaded adjustable eye bolt 49 attached to a plate 59 that is welded to the inside of C-channel 32 (see, e.g., FIG. 6*b*). Cable 41 is terminated to adjustable eyebolt 49 using multiple wire rope clips 57 shown in FIGS. 5 and 6*b*. Multiple sheaves 45 and 46 are each pinned by a pair of pins 51 (see, e.g., FIG. 4*a*), which prevent sheaves 45 and 46 from rotating (except when pins 51 are removed) as cable 41 slides around them. Typically, pins 51 are removed to allow the rotation of sheaves 45 and 46 in connection with the resetting of attenuator 10 after impact by a vehicle.

Figure 2A:
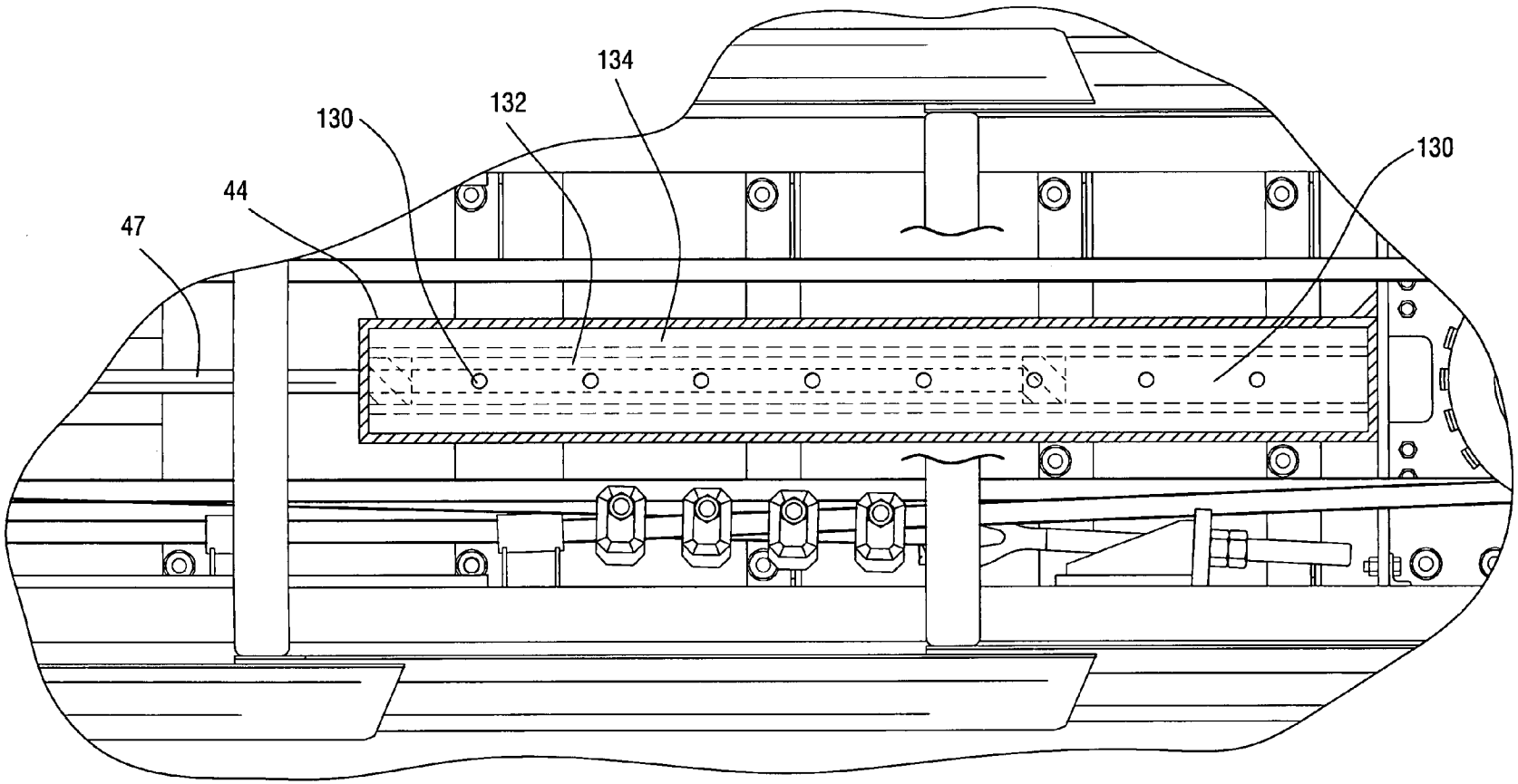
FIG. 2A is a partial plan view of the crash attenuator of the present invention, showing the cylinder in partial cross section.

When front section 12 is hit by a vehicle 50, it is pushed back by vehicle 50 until sled 18 contacts the support frame 26' of the first mobile section 14' behind front section 12. When front section 12 begins to move backwards after being struck by a vehicle, cable 41 in combination with cylinder 44 exerts a force that resists the movement of section 12 and sled 18 backwards. The resistive force exerted by cable 41 is controlled by shock-arresting cylinder 44. As shown in FIG. 2A, cylinder 44 is metered with internal orifices 130 running longiiudinally within cylinder 44. The orifices 130 in cylinder 44 allow a hydraulic or pneumatic fluid from a first, inner compartment 132 withih piston 44 escape to a second, outer jacket compartment 134 of cylinder 44. The orifices 130 control the amount of fluid that can move from the inner compartment 132 to the outer compartment 134 at any given time. As piston rod 47 moves past various orifices 130 within cylinder 44, those orifices 130 become unavailable for fluid movement, resulting in an energy-dependent resistance to a compressing force being exerted on piston rod 47 of cylinder 44 by cable 41 as it is pulled around the pair of multiple sheaves 45 and 46 in response to being pulled backwards by sled 18 of front section 12. The size and spacing of the orifices 130 within cylinder 44 are preferably designed to steadily decrease the amount of fluid that can move from the inner compartment to the outer compartment of cylinder 44 at any given time in coordination with the decrease in velocity of impacting vehicle 50 over a predefined distance so that vehicle 50 experiences a substantially constant rate of deceleration to thereby provide a steady ride-down in velocity for vehicle 50. Also, this arrangement increases or decreases resistance, depending on whether the impacting vehicle has a higher or lower velocity, respectively, than cylinder 44 is designed to readily handle, allowing extended ridedown distances for both slower velocity vehicles (due to decreased resistance) and higher velocity vehicles (due to increased resistance).

Cylinder 44's control of the resisting force exerted on sled 18 by cable 41 results in attenuator 10 providing a controlled ride-down of any vehicle 50 impacting attenuator 10 that is based on the kinetic energy of vehicle 50 as it impacts attenuator 10. When vehicle 50 first impacts sled 18 of attenuator 10, its initial velocity is very high, and, thus, initially, sled 18 is accelerated by vehicle 50 to a very high velocity. As sled 18 translates backwards, cable 41 is pulled backwards and around sheaves 45 and 46 very rapidly, causing cylinder 44 to be compressed very rapidly. In response to this rapid compression, initially, a large amount of the hydraulic fluid in cylinder 44 must be transferred from the inner compartment 132 to the outer compartment 134 of cylinder 44. As vehicle 50 slows down, less fluid needs to pass from the inner compartment 132 to the outer compartment 134 of cylinder 44 to maintain a steady reduction in the velocity of vehicle 50. The result is a steady deceleration of vehicle 50 with a substantially constant g-force being exerted on the occupants of vehicle 50 as it slows down.

It should be noted that the fluid compartments of cylinder 44 can be of alternative designs, wherein the first and second compartments, which are inner and outer compartments 132 and 134, respectively, in the embodiment described above, are side by side or top and bottom, by way of alternative examples.

It should also be noted that the design and operation of cylinder 44 and piston rod 47 can be reversed, wherein piston rod 47's rest position is to be initially within cylinder 44, rather than initially extended from cylinder 44. In this alternative embodiment, cable 41 would be terminated at the end of piston rod 47 and both the first and second multiplicity of sheaves 45 and 46 would be stationary. In this alternative embodiment, when front section 12 is impacted by a vehicle such that sled 18 translates away from the impacting vehicle, cable 41 would cause piston rod 47 to extend out of cylinder 44 as cable 41 slides around sheaves 45 and 46. Cylinder 44 would again include orifices to control the amount of fluid being transferred from a first chamber to a second chamber as piston rod 47 extends out of cylinder 44.

Figure 2B:
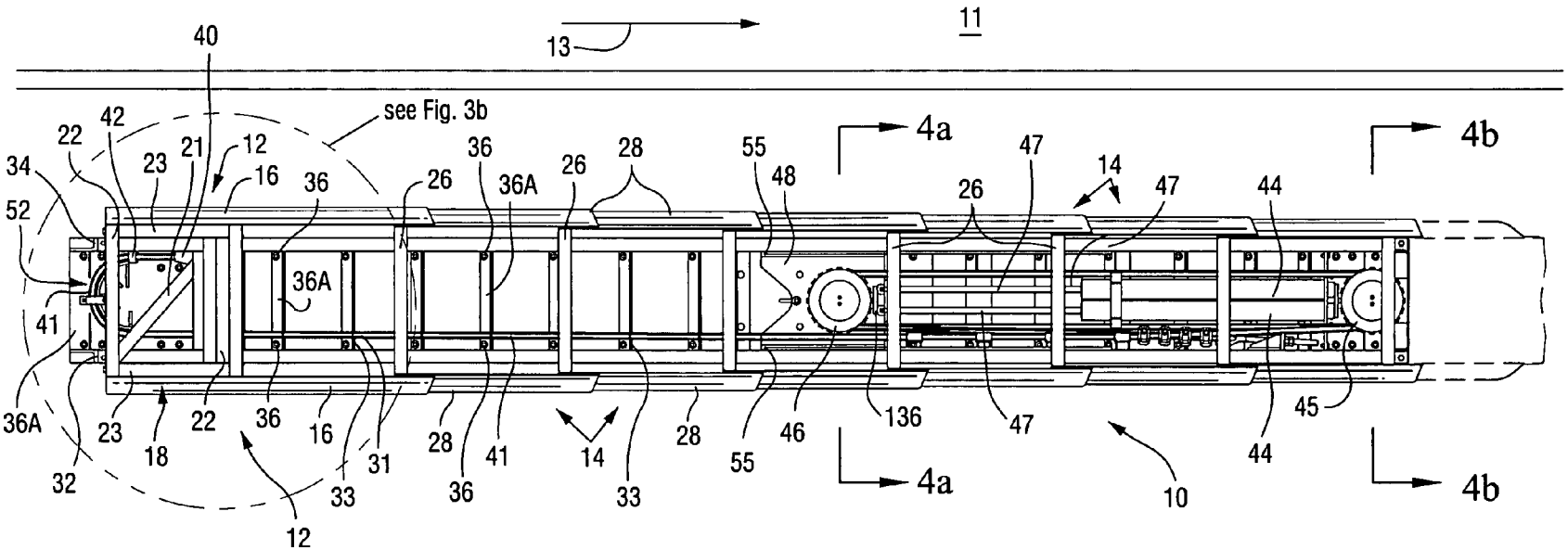
FIG. 2B is a plan view of the crash attenuator of the present invention in its fully extended position using two cylinders and piston rods instead of one.

It should also be noted that multiple cylinders 44 and/or multiple cables 41 could be used in the operation of crash attenuator 10 of the present invention. In these alternative embodiments, the multiple cylinders 44 could be positioned in tandem, as shown in FIG. 2B, with corresponding multiple, compressible piston rods 47 being attached to movable plate 48 on which movable multiple sheaves 46 are mounted through an appropriate bracket 136. In this embodiment, at least one cable 41 would still be looped around multiple sheaves 45 and 46, after which it would be terminated in eye bolt 49 attached to plate 59. Alternatively, one or more cables 41 could be terminated at the end of multiple, extendable piston rods 47 after being looped around multiple sheaves 45 and 46. Here, again, multiple cylinders 44 could be positioned in tandem. A single cable 41 would be attached to extendable piston rods 47 through an appropriate bracket (not shown).

Where a vehicle having a smaller mass strikes attenuator 10, it is slowed down more from the mass of attenuator 10 with which it is colliding and which it must accelerate upon impact, than will a vehicle having a larger mass. The initial velocity of front section 12 accelerated upon impact with the smaller vehicle will be less, and thus, the resistive force exerted by cable 41 in combination with cylinder 44 on sled 18 will be less because the orifices available in cylinder 44 will allow more fluid through until the smaller vehicle reaches a point where cylinder 44 is metered to stop the vehicle. Thus, the crash attenuator 10 of the present invention is a vehicle-energy-dependent system which allows vehicles of smaller masses to be decelerated in a longer ride-down than fixed force systems that are designed to handle smaller and larger mass vehicles with the same fixed stopping force.

The friction from cable 41 being pulled around open backed tube 42 and multiple sheaves 45 and 46 dissipates a significant amount of the kinetic energy of a vehicle striking crash attenuator 10. The dissipation of a vehicle's kinetic energy by such friction allows the use of a smaller bore cylinder 44. The multiple loops of cable 41 around sheaves 45 and 46 provides a 6 to 1 mechanical advantage ratio, which allows a 34.5" stroke for piston rod 47 of cylinder 44 with a 207" vehicle travel distance. It should be noted that where cable 41 is formed from a material that produces less friction when cable 41 is pulled around open backed tube 42 and multiple sheaves 45 and 46 a smaller amount of the kinetic energy of a vehicle striking crash attenuator 10 will be dissipated from friction. The dissipation of a smaller amount of a vehicle's kinetic energy by such lesser amount of friction will require the use of a cylinder 44 with a larger bore and/or orifices with having a larger size that are preferably designed to further decrease the amount of hydraulic fluid that can move from the inner compartment to the outer compartment of cylinder 44 at any given time.

It is preferable to use a premium hydraulic fluid in cylinder 44 which has fire resistance properties and a very high viscosity index to allow minimal viscosity changes over a wide ambient mean temperature range. Preferably, the hydraulic fluid used in the present invention is a fire-resistant fluid, such as Shell IRUS-D fluid with a viscosity index of 210. It should be noted, however, that the present invention is not limited to the use of this particular type of fluid.

The resistive force exerted by the cable and cylinder arrangement used with the crash attenuator 10 of the present invention maintains the deceleration of an impacting vehicle 50 at a predetermined rate of deceleration. i.e., preferably 10 millisecond averages of less than 15 g's, but not to exceed the maximum 20 g's specified by NCHRP Report 350.

In the present invention, the same cable and cylinder arrangement is used for vehicle velocities of 100 kmh, which is in the NCHRP Level 3 category, as is used for vehicle velocities of 70 kmh (NCHRP Level 2 category unit), or with higher velocities in accordance with NCHRP Level 4 category. Level 2 units of the crash attenuator would typically be shorter than Level 3 units, since the length needed to stop a slower moving vehicle of a given mass upon impact is shorter than the same vehicle moving at a higher velocity upon impact. Similarly, an attenuator designed for Level 4 would be longer since the length needed to stop a faster moving vehicle of the same mass is longer. Thus, with the crash attenuator of the present invention, it is the velocity of a vehicle impacting the attenuator, not simply the mass of the vehicle, that determines the stopping distance of the vehicle to thereby meet the g force exerted on the vehicle during the vehicle ride-down as specified in NCHRP Report 350. In this regard, it should be noted that the number of mobile sections and support frames that a crash attenuator could change, depending on the NCHRP Report 350 category level of the attenuator.

When a vehicle 50 collides with front section 12, which is initially at rest, front section 12 is accelerated by vehicle 50 as the cable and cylinder arrangement of the present invention resists the backwards translation of section 12. Acceleration of front section 12 and sled 18 reduces a predetermined amount of energy resulting from vehicle 50 impacting the front end of crash attenuator 10. To comply with the design specifications published in NCHRP Report 350, an unsecured occupant in a colliding vehicle must, after travel of 0.6 meters (1.968 ft.) relative to the vehicle reach a preferred velocity of preferably 9 meters per second (29.52 ft. per sec.) or less relative to the vehicle, and not exceeding 12 meters per second. This design specification is achieved in the present invention by designing the mass of front section 12 to achieve this occupant velocity for a crashing vehicle having a minimum weight of 820 kg. and a maximum weight of 2000 Kg., and by providing a reduced initial resistive force exerted by the cable and cylinder arrangement of the present invention that is based on the kinetic energy of a vehicle as it impacts the crash attenuator 10. Thus, in the crash attenuator 10 of the present invention, during the initial travel of front section 12, an unsecured occupant of a crashing vehicle will reach a velocity relative to vehicle 50 that preferably results in an occupant impact with the interior of the vehicle of not more than 12 meters per second.

Referring now to FIGS. 8–10, when a crashing vehicle 50 hits the front surface 52 of crash attenuator 10's front section 12, that section is caused to translate backwards on guiderails 32 and 34 towards the mobile sections 14 behind front section 12. As front section 12 translates backwards with crashing vehicle 50, the rear part 54 of front section 12's support sled 18 crashes into the support frame 26' of the mobile section 14' just behind front section 12. In addition, the corrugated panels 16 supported by sled 18 also translate backwards with front section 12 and slide over the corrugated panels 28' supported by support frame 26' of mobile section 14'.

As crashing vehicle 50 continues travelling forward, front section 12 and mobile section 14' continue to translate backwards, and support frame 26' of mobile section 14' then crashes into the support frame 26" of the next mobile section 14". The continued forward travel of crashing vehicle 50 causes front section 12 and mobile sections 14' and 14" to continue translating backwards, whereupon support frame 26" of mobile section 14" crashes into the support frame 26'" of the next mobile section 14'", and so on until vehicle 50 stops and/or front section 12 and mobile sections 14 are fully stacked onto one another.

The corrugated panels 28' supported by frame 26' also translate backwards with mobile section 14' and slides over the corrugated panels 28" supported by support frame 26" of the next mobile section 14". Similarly, the corrugated panels 28" supported by frame 26" translate backwards and slide over the corrugated panels 28'" supported by support frame 26'" of the next mobile section 14'", and so on until vehicle 50 stops and/or corrugated panels 28 are fully stacked onto one another as shown in FIG. 7.

Figures 18A, 18B, 18C:
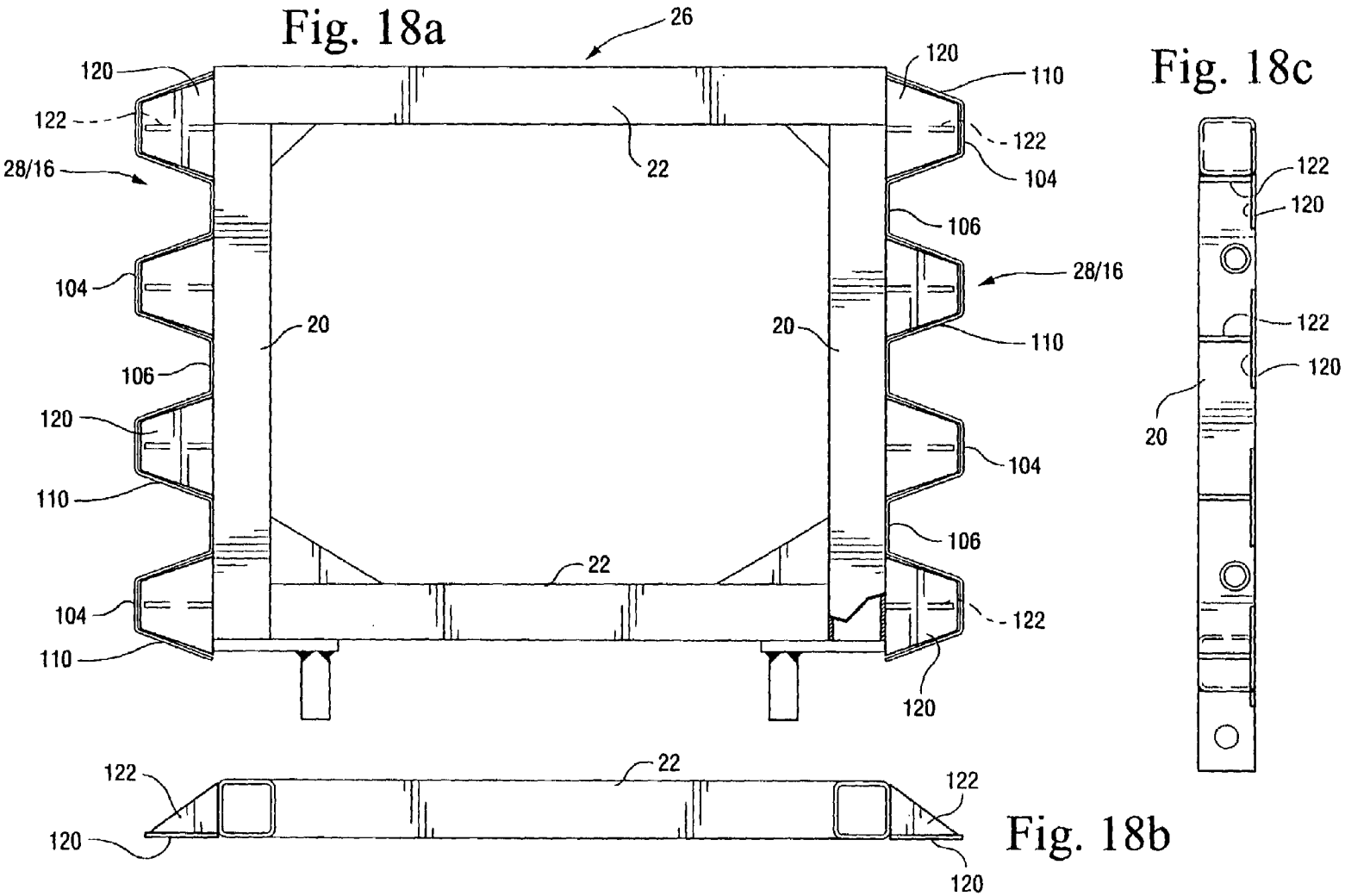
FIGS. 18*a*–18*c* are front, top and side views, respectively, of a support frame for the corrugated side panels showing different views of brackets and gussets used to further support the side panels.

As seen in FIG. 18*a* and 18*c*, the top and bottom edges of side panels 16 and 28 may or may not extend beyond the tops and bottoms, respectively, of the sled 18 and the support frames 26. To prevent the top and bottom edges from being unsupported in a side impact situation, mounted behind side panels 16 and 28 are a plurality of hump gussets 120 located approximately 3/16" underneath the top and bottom ridges 104 of such panels. Hump gussets 120 support panels 16 and 28 from bending over or under during a side impact. Referring now to FIGS. 18*a* to 18*c*, hump gussets 120 are preferably 3/16" trapezoidal-shaped plates welded to vertical members 20 and to horizontal support gussets 122, which preferably are 1/4" triangular-shaped plates that are also welded to vertical members 20. Gussets 120 and 122 stop all opening of the edges of panels 16 and 28 due to crushing upon impact right at the juncture of such panel with another panel 28 upon a reverse hit by a vehicle. The hump gussets 120 give the top and bottom ridges 104 of panels 16 and 28 rigidity to help strengthen the other ridges 104 of such panels.

The mobile frames 14 are symmetrical by themselves side-to-side, but asymmetrical compared to each other. Looking from the rear to the front of crash attenuator 10, each mobile frame 14's width is increased to allow the side corrugated panels 28 from frame 14 to frame 14 to stack over and onto each other. The collapsing of the side corrugated panels 16 and 28 requires that the front section 12 corrugated panels 16 be on the outside when side corrugated panels 28 are fully stacked over and onto one another and all of frames 14 are stacked onto section 12, as shown in FIG. 7. The taper from frame 14 to frame 14, and thus support frame 26 to support frame 26, is necessary to let the panels 28 stacked over and onto one another and not be forced outward as they telescope down. The nominal width of support frames 26 is approximately 24", not including panels 28 (which add an additional 6.875"), but this width varies due to the taper in width of frames 26 from front to back of crash attenuator 10.

It should be noted that, alternatively, each mobile frame 14's width (looking from the rear to the front of crash attenuator 10,) can be decreased to allow the side corrugated panels 28 from frame 14 to frame 14 to stack within each other. In this alternative embodiment, the collapsing of the side corrugated panels 28 requires that the front section 12 and corrugated panels 16 be on the inside when side corrugated panels 28 are fully stacked within one another and section 12 and all of the trailing frames 14 are stacked within the last frame 14.

The first pairs of side-keeper bolts 30 holding panels 28' onto the first support frame 26' and protruding through slits 24 in panels 16 slide along slits 24 as panels 16 translate backwards with front section 12. Similarly, the second pairs of side-keeper bolts 30 holding panels 28" onto the second support frame 26" and protruding through slits 24 in panels 28' slide along slits 24 as panels 28' translate backwards with mobile section 14'. Each subsequent pair of side-keeper bolts 30 protruding through slits 24 in subsequent panels 28" and so on slide along slits 24 in such panels as they translate backwards with their respective mobile sections 14" and so on. The first pairs of side-keeper bolts 30 holding panels 28' onto the first support frame 26' have extension wings to provide more holding surface for the initial high velocity acceleration and increased flex of panels 16.

Although the present invention uses a cable and cylinder arrangement with a varying restraining force to control the rate at which a crashing vehicle is decelerated to safely stop the vehicle, accelerating the mass of the crash attenuator's various frames and other structures during collision also contributes to the stopping force provided by the attenuator. Indeed, the total stopping force exerted on a colliding vehicle is a combination of friction, the resistance exerted by the shock arresting cylinder and the acceleration of the crash attenuator structural masses in response to the velocity of the colliding vehicle upon receipt, and crush factors in the body and frame of the crashing vehicle.

In a vehicle crash situation like that shown in FIGS. 8–10, typically, front section 12 and mobile sections 14 will not be physically damaged because of the manner in which they are designed to translate away from crashing vehicle 50 and telescope down. The result is that the amount of linear space occupied by front section 12 and mobile sections 14 is substantially reduced, as depicted in FIGS. 8, 9 and 10. After a crash event, front section 12 and mobile sections 14 can then be returned to their original extended positions, as shown in FIGS. 1 and 2, for reuse. As previously noted, multiple sheaves 45 and 46 are each pinned by a pair of pins 51, which prevents sheaves 45 and 46 from rotating except when pins 51 are removed to allow the rotation of sheaves 45 and 46 in connection with the resetting of attenuator 10 after impact by a vehicle.

To reset attenuator 10 after impact by a vehicle 50, front sled 18 and frames 26 are pulled out first to allow access to, and removal of, the pins 51 in the multiple sheaves 45 and 46. Resetting is accomplished by detaching spelter socket 40, pulling out sled 18 and frames 26, removing the anti-rotation pins 51 in sheaves 45 and 46, pulling out the mobile sheaves 46, which extends piston rod 47 of cylinder 44 and retracts cable 41, and then reattaching spelter socket 40 to sled 18. Two small shear bolts 55 at the very front corners of the movable sheave support plate 48 (FIG. 2) on movable plate 48, which shear on vehicle impact, hold cylinder piston rod 47 extended. Without shear bolts 55, the tension on cable 41 would tend to retract movable plate 48 and, thus, piston rod 47. A small shield (not shown) bolted to movable plate 48 protects the sheaves if there is any vehicle undercarriage contact.

As previously noted, side panels 28 mounted on the sides of mobile sections 14 are somewhat shorter in length than side panels 16 mounted on the sides of front section 12. In all other respects, side panels 28 and side panels 16 are identical in construction to one another. Accordingly, the following description of side panel 16 is applicable to side panel 28.

FIG. 15 is a plan view of a side panel 16. As previously noted, panels 16 and 28 are corrugated panels including a plurality of angular corrugations or flutes that include a plurality of flat ridges 104 and flat grooves 106 connected together by flat slanted middle sections 110. Preferably, each panel 28 includes four flat ridges 104 and three flat grooves 106 connected together by middle sections 110. Preferably, extending within the two outer grooves 106 are the slits 24 through which pass the side-keeper bolts 30 that allow the floating end 29 of each panel 28 to overlap the fixed end 27 of the next corrugated panel 28 (not shown in FIG. 15) longitudinally behind the first panel and adjacent to it, as shown in FIG. 1.

As can be seen in FIG. 15, at the leading or fixed end 27 of panel 28, the ridges 104, grooves 106 and middle sections 110 are coextensive with one another so as to form a straight leading edge 100. In contrast, at the floating or trailing end 29 of panel 28, the ridges 104, grooves 106 and middle sections 10 are not coextensive with one another. Rather, the grooves 106 extend longitudinally further than the ridges 104, so as to form in combination with the middle sections 110 connecting them together, a corrugated trailing edge 102.

Figure 17:
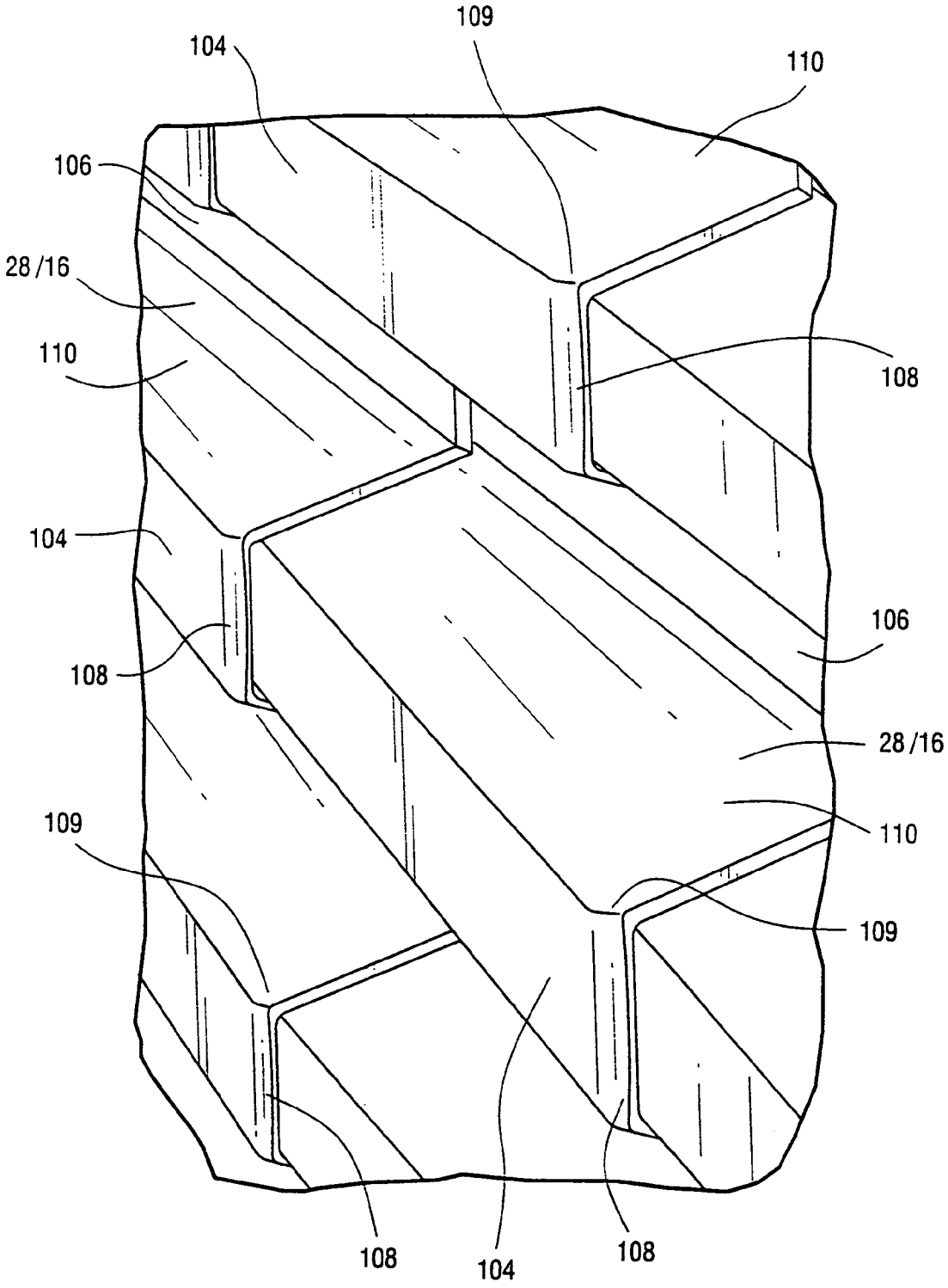
FIG. 17 is a partial side perspective view showing portions of several side panels used with the crash attenuator of the present invention.

Referring now to FIG. 17, it can be seen that a portion 108 of the trailing edge of each ridge 104 is bent in toward the succeeding ridge 104 to preclude a vehicle reverse impacting crash attenuator 10 from getting snagged by the trailing edge 102 of panel 28. To accommodate the bent portion 108 of each ridge 104, the middle sections 110 connecting the ridge 104 to adjacent grooves 106 each have a curved portion 109. Curved portion 109 also serves to prevent a vehicle reverse impacting the crash attenuator from getting snagged by the trailing edge 102 of the panel 28.

Figure 16C:
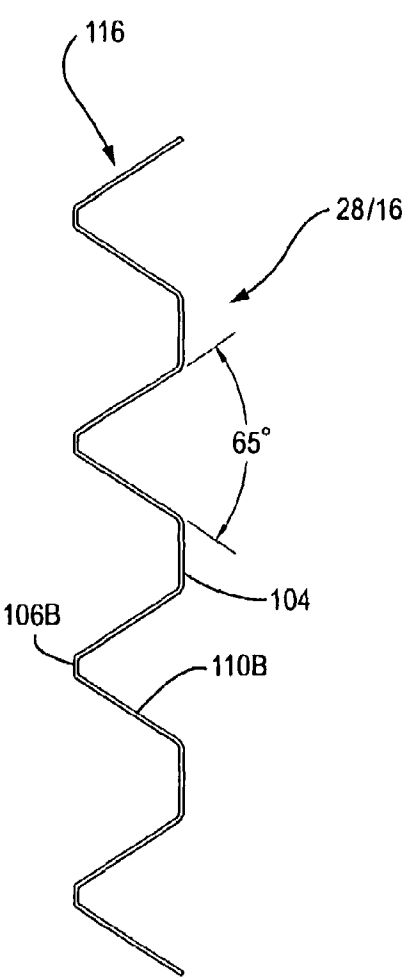
FIGS. 16*a*–16*c* are cross sectional elevational views showing the profiles of several embodiments of the corrugated side panel used with the crash attenuator of the present invention.
Figure 16B:
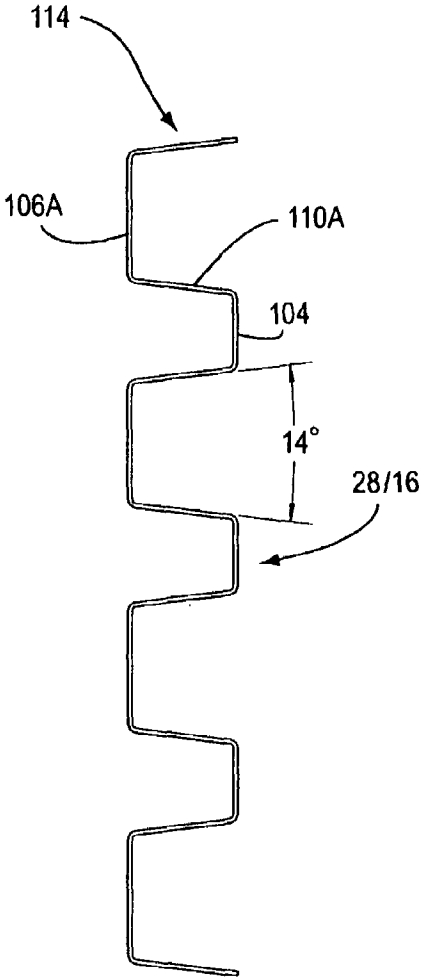
Figure 16A:
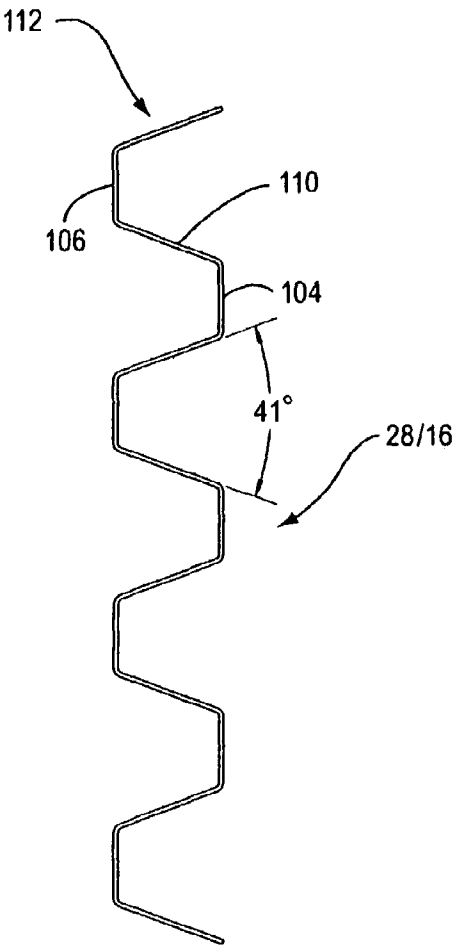

FIGS. 16*a* to 16*c* show several embodiments of the trapezoidal-like profile of angular corrugated side panels 28. Each of FIGS. 16*a* to 16*c* shows a different embodiment with a different angle for the middle sections 110 joining the ridges 104 and grooves 106 of the panels. FIG. 16*a* shows a first embodiment of side panel 28 wherein the middle sections 110 form a 41° angle, such that the length of the ridges 104 and grooves 106 are approximately the same. FIG. 16*b* shows the profile of a second embodiment of corrugated panel 28 in which the middle sections 110 form a 14° angle, such that the length of the ridges 104 are longer than the grooves 106. FIG. 16*c* shows the profile of a third embodiment of corrugated panel 28 in which the middle sections 110 form a 65° angle, such that the length of the ridges 104 are shorter than the grooves 106. Preferably, side panels 16 and 28 are formed from 10 gauge grade 50 steel, although 12 gauge steel and mild and other higher grades of steel could also be used.

Although corrugated side panels 16 and 28 are used with the crash attenuator 10 of the present invention, it should be noted that the side panels may also be used as part of a guardrail arrangement not unlike the traditional W-corrugated panels and thrie beam panels used with guardrails. In a guardrail application, the width of side panels 16/28 would typically be less than the width of panels 16 and 28 used with crash attenuator 10 of the present invention.

In the preferred embodiment of the invention, rigid structural panel members provide a smooth transition from crash attenuator 10 to a fixed obstacle of different shapes (See FIGS. 11*a* through 14*b*) located longitudinally behind attenuator 10. A terminal brace 54 (numbered 26 on 11*b*, 12*b*, 13*b*, 14*b* and only numbered on 13*a*) is the last support frame that is used to attach the transitions to a given fixed obstacle. Terminal brace 54 is bolted to the end of guardrail 32 and 34.

Figure 11A:
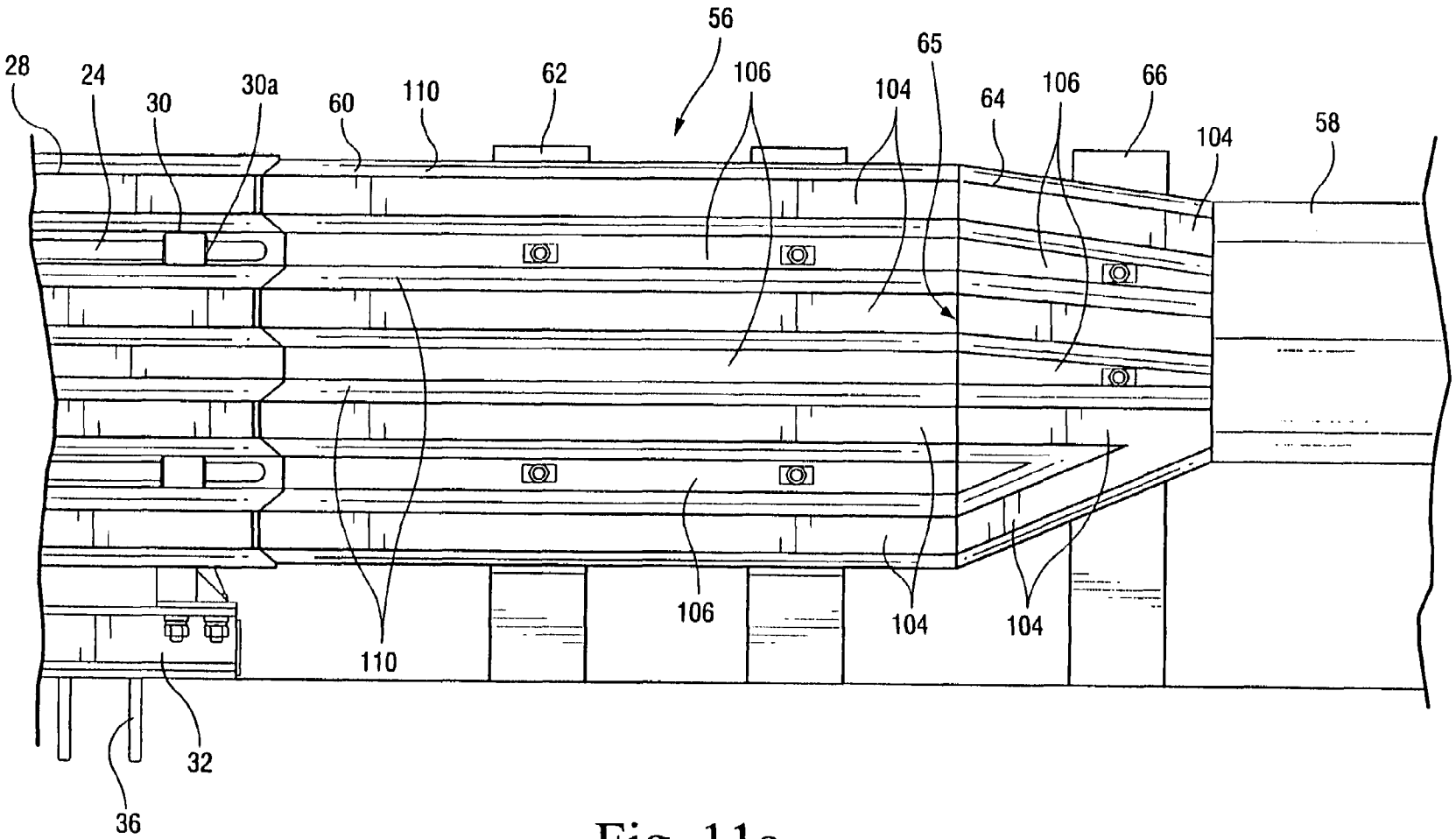
FIG. 11*a* is a side elevational view of a first embodiment of a transition section for connecting the crash attenuator to a thrie-beam guardrail.
Figure 11B:
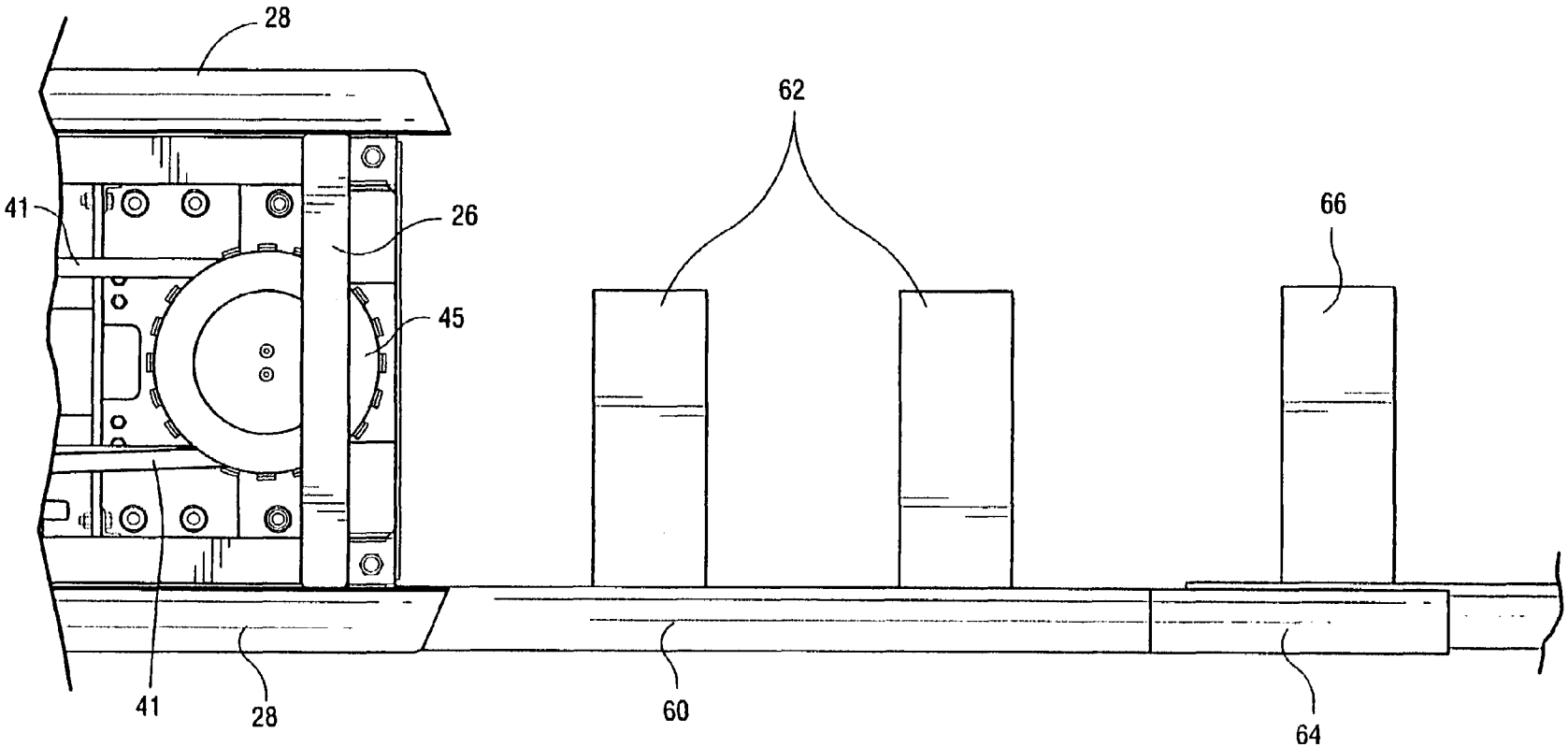
FIG. 11*b* is a plan view of the first transition section for connecting the crash attenuator to the thrie-beam guardrail.

FIGS. 11*a* and 11*b* show different views of a transition 56 for connecting crash attenuator 10 to a thrie-beam guardrail 58. Transition 56 includes a first section 60 that is bolted to a pair of vertical supports 62 and a tapering second section 64 that is bolted to a third vertical support 66. The tapering second section 64 serves to reduce the vertical dimension of transition 56 from the larger dimension 65 of corrugated panel 28 that is part of crash attenuator 10 to the smaller dimension of the thrie-beam guardrail 58. As can be seen in FIG. 11*a*, the flat ridges 104, flat grooves 106, and flat slanted middle sections 110 of tapering second section 64 are angled to meet and overlap the curved peaks and valleys of the thrie-beam 68. As can also be seen in FIG. 11*a*, the two bottommost flat ridges 104 of tapering second section 64 meeting together to form, with their corresponding flat grooves 106 and flat slanted middle sections 10, an overlap of the bottommost curved peak and valley of the thrie-beam 68.

Figure 12A:
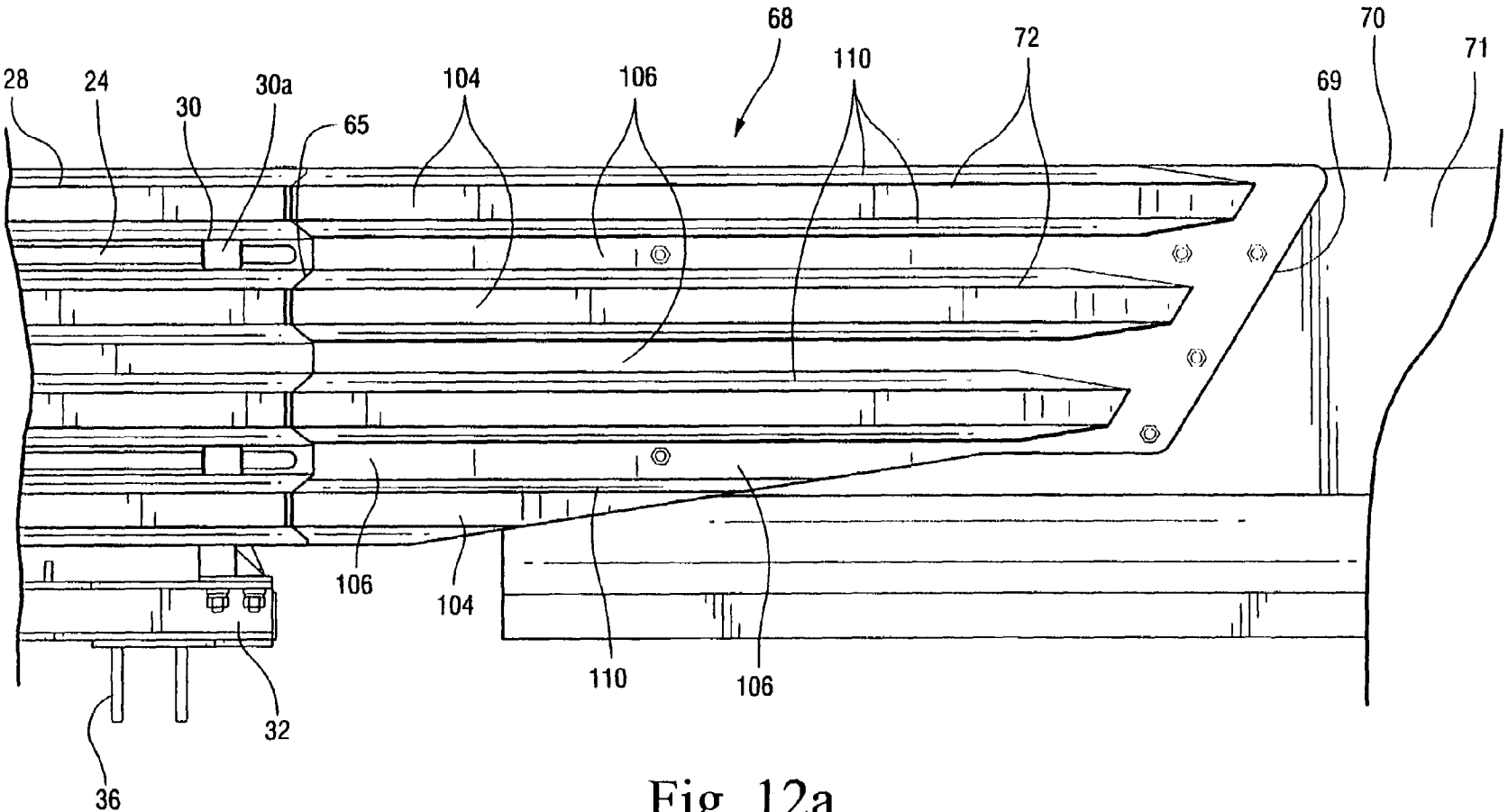
FIG. 12*a* is a side elevational view of a second embodiment of the transition section for connecting the crash attenuator to a jersey barrier.
Figure 12B:
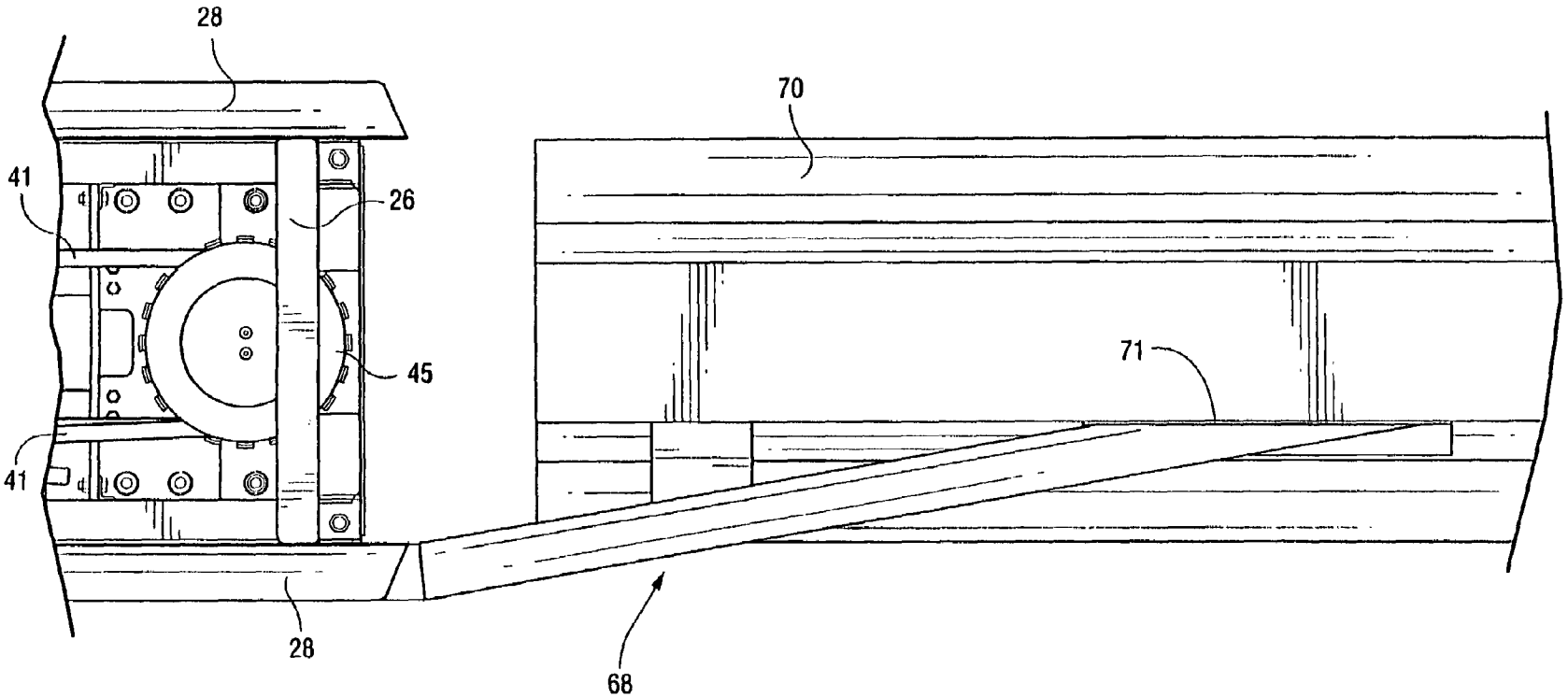
FIG. 12*b* is a plan view of the second transition section for connecting the crash attenuator to the jersey barrier.
Figure 12C:
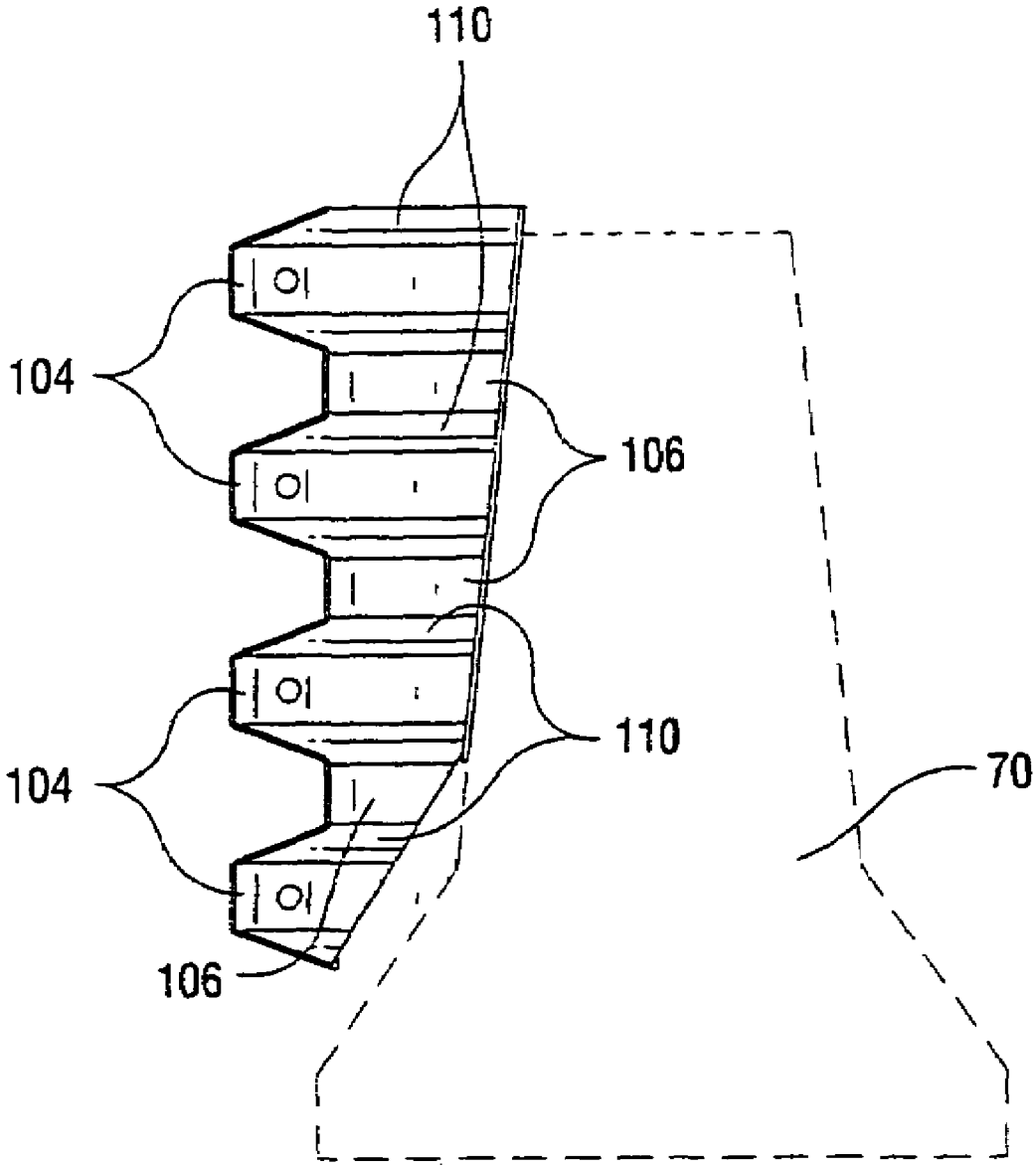
FIG. 12*c* is an end elevational view of a second embodiment of the transition section for connecting the crash attenuator to a jersey barrier.

FIGS. 12*a* to 12*c* show different views of a transition 68 for connecting crash attenuator 10 to a jersey barrier 70. Transition 68 has a tapering design that allows it to provide a transition from the larger dimension 65 of corrugated panel 28 that is part of crash attenuator 10 to the smaller dimension 69 of the upper vertical part 71 of jersey barrier 70. Transition 68 is bolted between terminal brace 54 and vertical part 71 of jersey barrier 70. Transition 68 includes a plurality of corrugations 72 of varying length to accommodate the tapering design of transition 68. Corrugations 72 extend the flat ridges 104, flat grooves 106, and flat slanted middle sections 110 of the side panels 28 and provide additional structural strength to transition 68.

Figure 13A:
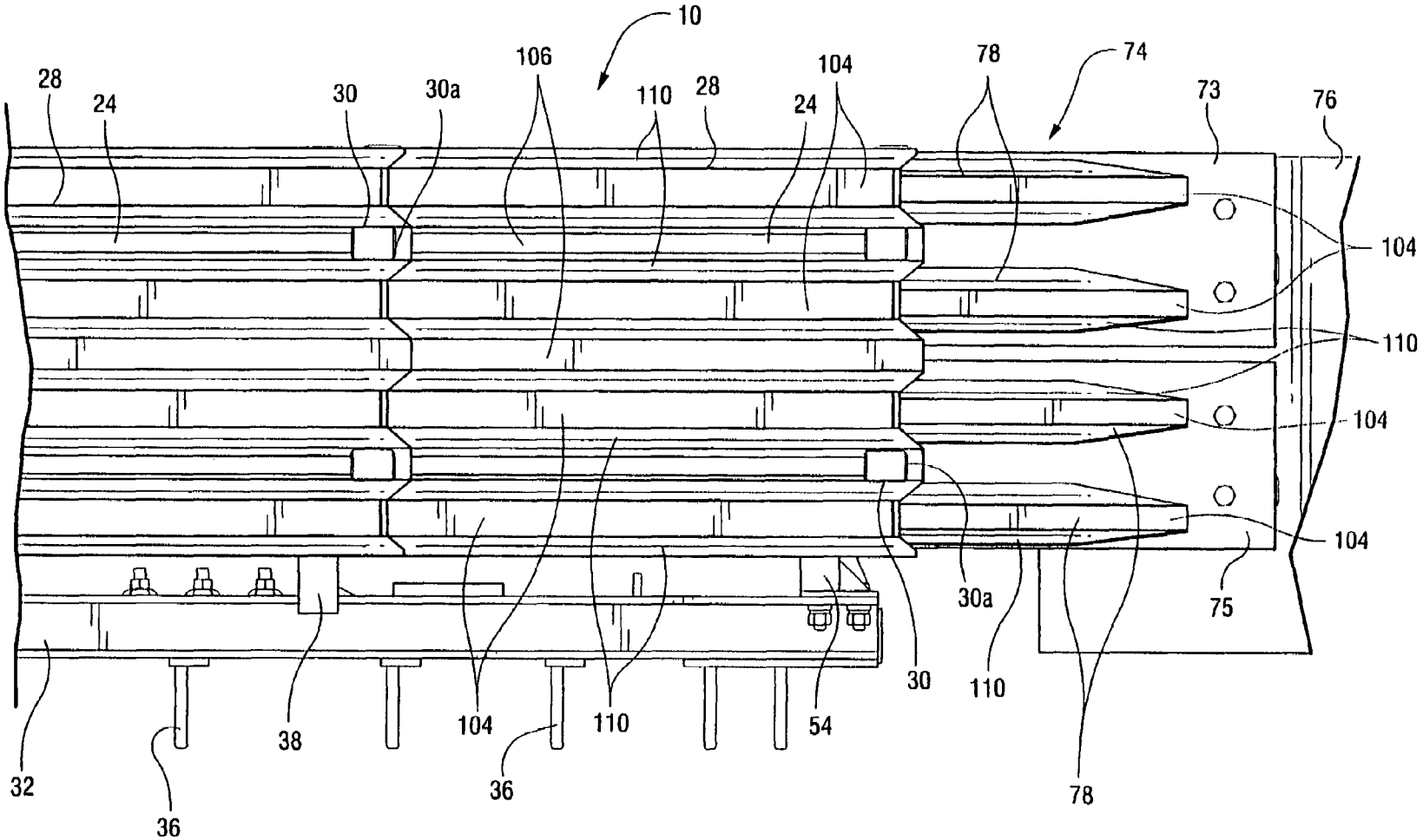
FIG. 13*a* is a side elevational view showing a third embodiment of the transition section for connecting the crash attenuator to a concrete block.
Figure 13B:
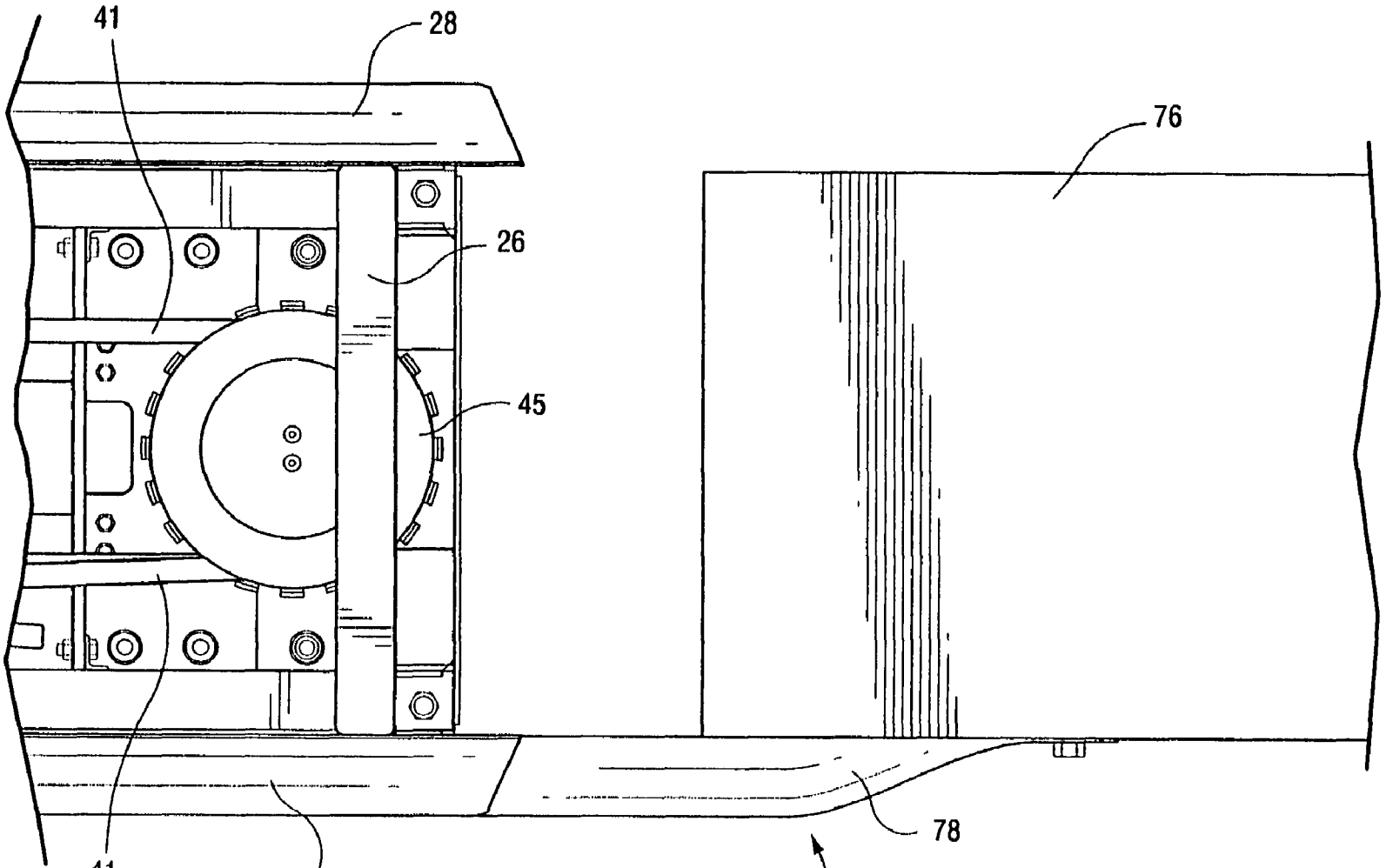
FIG. 13*b* is a plan view of the third transition section for connecting the crash attenuator to the concrete block.

FIGS. 13*a* and 13*b* show different views of a transition 74 for connecting crash attenuator 10 to a concrete barrier 76. Transition 74 has two transition panels 73 and 75 (which can be a single panel) that allow it to provide a transition from the corrugated panel 28 that is part of crash attenuator 10 to the concrete barrier 76. Transition 74 is bolted between terminal brace 54 and concrete barrier 76. Panels 73 and 75 of transition 74 each include a pair of corrugated indentations 78 of the same length that extend the flat ridges 104, flat grooves 106, and flat slanted middle sections 110 of the side panels 28 and that provide additional structural strength to panels 73 and 75 of transition 74.

Figure 14A:
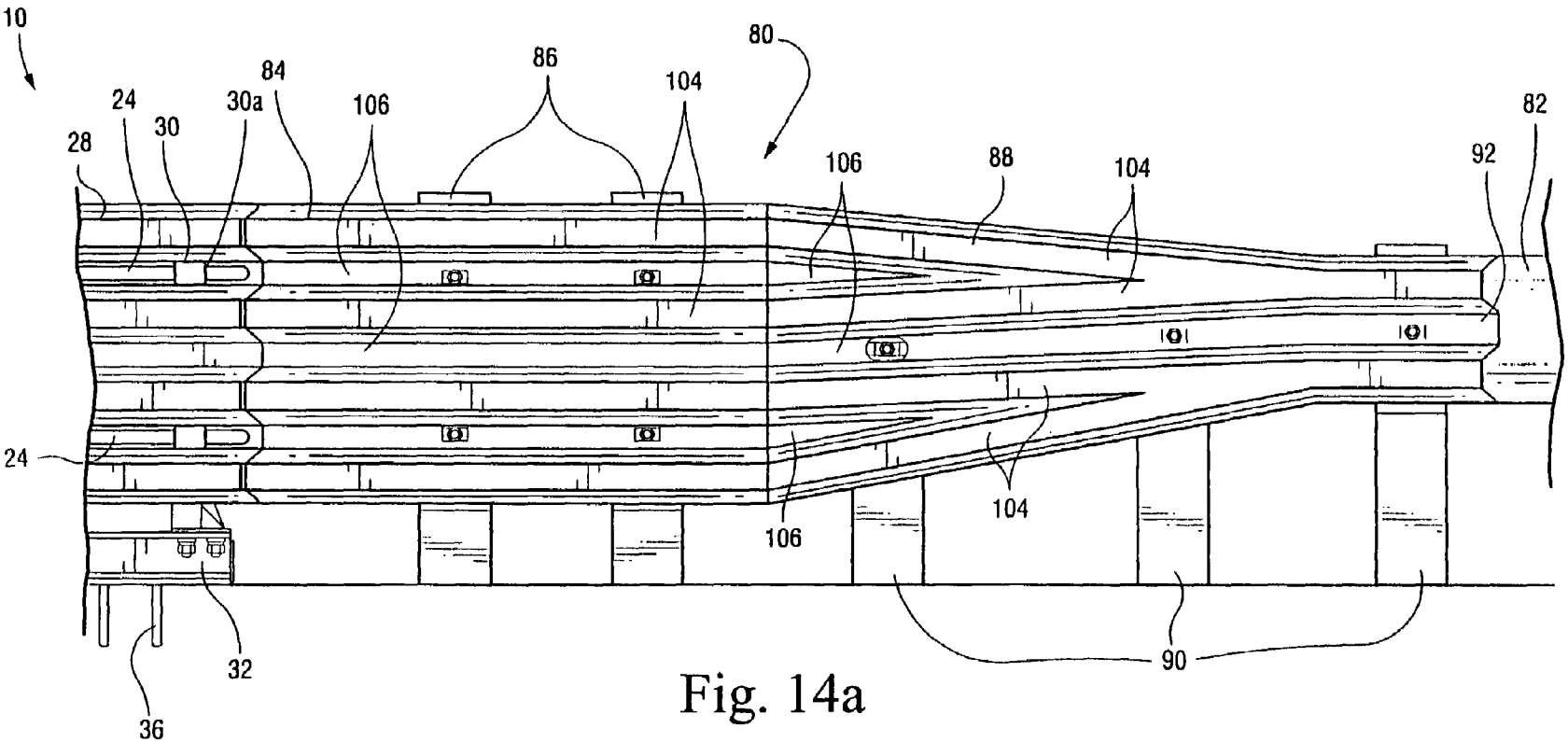
FIG. 14*a* is a side elevational view showing a fourth embodiment of the transition section for connecting the crash attenuator to a W-beam guardrail.
Figure 14B:
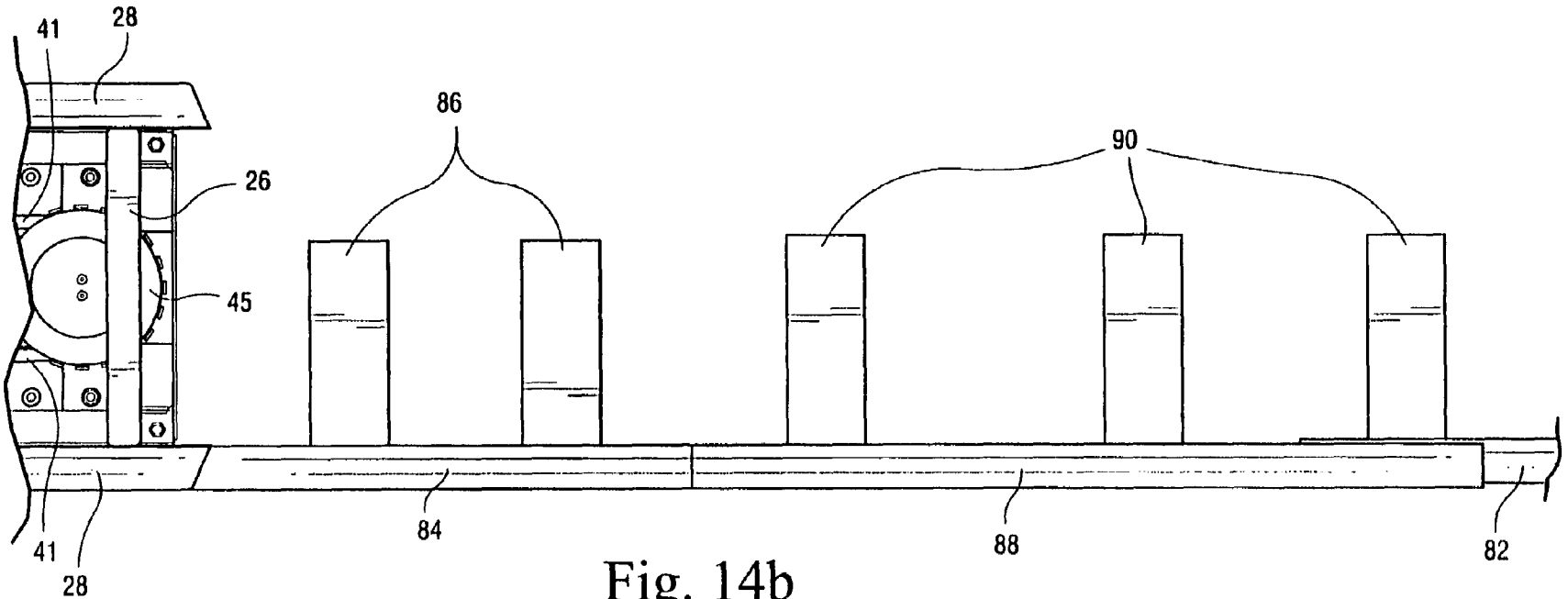
FIG. 14*b* is a plan view of the fourth transition section for connecting the crash attenuator to the W-beam guardrail.

FIGS. 14*a* and 14*b* show different views of a transition 80 for connecting crash attenuator 10 to a W-beam guardrail 82. Transition 80 includes a first section 84 that is bolted to terminal brace 54 and a pair of vertical supports 86 and a tapering second section 88 that is bolted to three vertical supports 90. The tapering second section 88 serves to reduce the vertical dimension of transition 80 from the larger dimension 65 of corrugated panel 28 that is part of crash attenuator 10 to the smaller dimension 92 of the W-beam guardrail 82. As can be seen in FIG. 14*a*, the flat ridges 104, flat grooves 106, and flat slanted middle sections 110 of tapering second section 88 are angled to meet and overlap the curved peaks and valleys of the W-beam guardrail 82. As can also be seen in FIG. 14*a*, the two topmost and the two bottommost flat ridges 104 of tapering second section 88 meet together to form, with their corresponding flat grooves 106 and flat slanted middle sections 110, overlap of the top and bottom curved peaks and valleys of the W-beam 82.

Although the present invention has been described in terms of particular embodiments, it is not intended that the invention be limited to those embodiments. Modifications of the disclosed embodiments within the spirit of the invention will be apparent to those skilled in the art. The scope of the/present invention is defined by the claims that follow.

What is claimed is:

1. An apparatus for exerting a resisting force in response to an impacting object, the apparatus comprising:

a movable structure for bearing an impact by the object, the movable structure being formed from a plurality of structural members interconnected for structural rigidity, a cylinder, and a cable running between the cylinder and the movable structure, the cylinder including a plurality of orifices for transferring a fluid from a first compartment of the cylinder to a second compartment of the cylinder as a piston rod is moved within the cylinder by the cable, to thereby apply to the movable structure a varying force to resist the structure translating away when impacted by the object to thereby decelerate the object at or below a predetermined rate of deceleration.

2. The apparatus recited in claim 1, wherein the movable structure has a predefined mass and the cylinder has a piston rod that is compressible into the cylinder at a predefined rate so as to initially limit a resistance applied to the impacting object, after which the resistance is increased to safely stop the object at a relatively constant g-force.

3. The apparatus recited in claim 1, wherein the apparatus is further comprised of a first plurality of sheaves positioned at a first end of the cylinder and a second plurality of sheaves positioned at an end of a piston rod extending from a second end of the cylinder, and wherein the cable is looped around the first and second pluralities of sheaves.

4. The apparatus recited in claim 3, wherein the apparatus is further comprised of a third sheave mounted in front of the movable structure through which the cable runs from the structure to the first and second pluralities of sheaves.

5. The apparatus recited in claim 4, wherein the cable slides around the third sheave and the first and second pluralities of sheaves so as to cause friction between the cable and the sheaves that contributes to the deceleration of the object.

6. The apparatus recited in claim 5, wherein the first and second pluralities of sheaves are pinned to prevent them from rotating as the cable slides around them.

7. The apparatus as recited in claim 3, wherein the piston rod is compressible into the cylinder, and wherein the second plurality of sheaves positioned at the end of the piston rod is movably mounted at the bottom of the apparatus, so as to be movable with the piston rod as the piston rod is compressed into the cylinder by the cable.

8. The apparatus as recited in claim 3, wherein the piston rod is extendable from the cylinder, and wherein the second plurality of sheaves positioned at the end of the piston rod is movably mounted at the bottom of the apparatus, so as to be movable with the piston rod as the piston rod is extended out of the cylinder by the cable.

9. The apparatus recited in claim 3, further comprising multiple cylinders positioned in tandem and corresponding multiple, compressible piston rods attached to a movable plate on which the second plurality of sheaves are mounted.

10. The apparatus recited in claim 1, wherein the plurality of orifices transfers a hydraulic fluid from the first compartment of the cylinder to the second compartment of the cylinder as the piston rod is compressed into the cylinder by the cable to thereby exert the varying force to resist the movable structure translating away when impacted by the object.

11. The apparatus recited in claim 10, wherein the cable is formed from a non-metallic material and wherein the cylinder has orifices that are sized to decrease the amount of hydraulic fluid that can move from a first compartment of the cylinder to a second compartment of the cylinder to compensate for a reduced amount of friction resulting from the cable sliding around the sheaves.

12. The apparatus recited in claim 1, wherein the plurality of orifices transfers a pneumatic fluid from the first compartment of the cylinder to the second compartment of the cylinder as the piston rod is compressed into the cylinder by the cable to thereby exert the varying force to resist the movable structure translating away when impacted by the object.

13. The apparatus recited in claim 12, wherein the cable is formed from a non-metallic material and wherein the cylinder has orifices that are sized to decrease the amount of pneumatic fluid that can move from a first compartment of the cylinder to a second compartment of the cylinder to compensate for a reduced amount of friction resulting from the cable sliding around the sheaves.

14. The apparatus recited in claim 1, wherein the plurality of orifices transfers a hydraulic fluid from the first compartment of the cylinder to the second compartment of the cylinder as the piston rod is extended out of the cylinder by the cable to thereby exert the varying force to resist the movable structure translating away when impacted by the object.

15. The apparatus recited in claim 1, wherein the plurality of orifices transfers a pneumatic fluid from the first compartment of the cylinder to the second compartment of the cylinder as the piston rod is extended out of the cylinder by the cable to thereby exert the varying force to resist the movable structure translating away when impacted by the object.

16. The apparatus recited in claim 1, wherein the cable is a steel rope cable.

17. The apparatus recited in claim 1, wherein the cable is a metallic cable having a tensile strength of at least 27,500 lbs.

18. The apparatus recited in claim 1, wherein the cable is a non-metallic cable having a tensile strength of at least 27,500 lbs.

19. The apparatus recited in claim 1, wherein the cable is a chain.

20. The apparatus recited in claim 19, wherein the chain has a tensile strength of at least 27,500 lbs.

21. The apparatus recited in claim 1, wherein the cable is a nylon rope cable.

22. The apparatus recited in claim 1, further comprising a plurality of cylinders for applying to the moveable structure the varying force.

23. The apparatus recited in claim 22, wherein each of the cylinders has a piston rod that is extendable out of the cylinder.

24. The apparatus recited in claim 22 wherein each of the cylinders has a piston rod that is compressible within the cylinder.

25. The apparatus recited in claim 1, wherein the predetermined rate of deceleration is substantially constant.

26. An apparatus for exerting a resisting force in response to an impacting object, the apparatus comprising:

a movable structure for bearing an impact by the object, the movable structure being formed from a plurality of structural members interconnected for structural rigidity, a cylinder, a cable running between the cylinder and the movable structure, a first plurality of sheaves positioned at a first end of the cylinder, and a second plurality of sheaves positioned at an end of a piston rod extending from a second end of the cylinder, the cable being looped around the first and second pluralities of sheaves, the cylinder and cable applying to the movable structure a varying force to resist the movable structure translating away when impacted by the object to thereby decelerate the object at or below a predetermined rate of deceleration.

27. The apparatus recited in claim 26, wherein the apparatus is further comprised of a third sheave mounted in front of the movable structure through which the cable runs from the structure to the first and second pluralities of sheaves.

28. The apparatus recited in claim 27, wherein the cable slides around the third sheave and the first and second pluralities of sheaves so as to cause friction between the cable and the sheaves that contributes to the deceleration of the vehicle.

29. The apparatus recited in claim 26, wherein the cylinder includes a plurality of orifices for transferring hydraulic fluid from a first compartment of the cylinder to a second compartment of the cylinder as the piston rod is compressed into the cylinder by the cable to thereby exert the varying force to resist the movable structure translating away when impacted by the object.

30. The apparatus recited in claim 26, wherein the cylinder includes a plurality of orifices for transferring pneumatic fluid from a first compartment of the cylinder to a second compartment of the cylinder as the piston rod is compressed into the cylinder by the cable to thereby exert the varying force to resist the movable structure translating away when impacted by the object.

31. The apparatus recited in claim 26, wherein the cylinder includes a plurality of orifices for transferring hydraulic fluid from a first compartment of the cylinder to a second compartment of the cylinder as the piston rod is extended out of the cylinder by the cable to thereby exert the varying force to resist the movable structure translating away when impacted by the object.

32. The apparatus recited in claim 26, wherein the cylinder includes a plurality of orifices for transferring pneumatic fluid from a first compartment of the cylinder to a second compartment of the cylinder as the piston rod is extended the cylinder by the cable to thereby exert the varying force to resist the movable structure translating away when impacted by the object.

33. The apparatus recited in claim 26, wherein the predetermined rate of deceleration is substantially constant.

* * * * *